US011192382B2

(12) United States Patent
Hayashi et al.

(10) Patent No.: US 11,192,382 B2
(45) Date of Patent: Dec. 7, 2021

(54) LIQUID CARTRIDGE INCLUDING CIRCUIT BOARD AND RESTRICTING SURFACE POSITIONED BELOW LIQUID PASSAGE

(71) Applicant: BROTHER KOGYO KABUSHIKI KAISHA, Nagoya (JP)

(72) Inventors: Masahiro Hayashi, Nagoya (JP); Hiroaki Takahashi, Nagoya (JP); Akinari Ishibe, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 95 days.

(21) Appl. No.: 16/524,567

(22) Filed: Jul. 29, 2019

(65) Prior Publication Data

US 2020/0070529 A1 Mar. 5, 2020

(30) Foreign Application Priority Data

Aug. 31, 2018 (JP) ..... JP2018-162363

(51) Int. Cl.
*B41J 2/175* (2006.01)

(52) U.S. Cl.
CPC ..... *B41J 2/17526* (2013.01); *B41J 2/17536* (2013.01)

(58) Field of Classification Search
CPC ..... B41J 2/17526; B41J 2/17536; B41J 2/17503; B41J 2/1752; B41J 2/17553; B41J 2/175; B41J 2/1754; B41J 2/18

See application file for complete search history.

(56) References Cited

U.S. PATENT DOCUMENTS 6,502,917 B1 * 1/2003 Shinada ..... B41J 2/17523 347/19
8,297,738 B1 10/2012 Kodama et al.
(Continued)

FOREIGN PATENT DOCUMENTS

CN 103448375 A 12/2013
EP 1 500 512 A1 1/2005
(Continued)

OTHER PUBLICATIONS

Extended European Search Report issued in corresponding European Patent Application No. 19183415.9, dated Feb. 5, 2020.
(Continued)

*Primary Examiner* — Huan H Tran
(74) *Attorney, Agent, or Firm* — Merchant & Gould P.C.

(57) ABSTRACT

A liquid cartridge includes: a housing; a liquid passage extending in a first lateral direction from the housing when the housing is in an operational posture; a sealing member provided in the liquid passage; a circuit board including an electrical contact; and a restricting surface positioned below the liquid passage. The restricting surface is capable of preventing the housing from moving in a second lateral direction opposite the first lateral direction. When the housing is in an operational posture, the liquid passage is positioned closer to the restricting surface than the circuit board is to the restricting surface with respect to a vertical direction perpendicular to the first lateral direction; and the circuit board and the restricting surface are positioned further in the second lateral direction relative to the sealing member.

20 Claims, 27 Drawing Sheets

(56) References Cited

U.S. PATENT DOCUMENTS

| | | | |
|---|---|---|---|
| 9,266,337 | B2 | 2/2016 | Aoki et al. |
| 2002/0167574 | A1 | 11/2002 | Shinada et al. |
| 2008/0106575 | A1 | 5/2008 | Shimizu et al. |
| 2008/0136878 | A1 | 6/2008 | Nozawa et al. |
| 2008/0284810 | A1 | 11/2008 | Shimizu et al. |
| 2011/0310197 | A1 | 12/2011 | Yazawa |
| 2014/0009543 | A1 | 1/2014 | Yazawa |
| 2018/0093484 | A1 | 4/2018 | Nukui et al. |
| 2018/0093485 | A1 | 4/2018 | Takahashi et al. |

FOREIGN PATENT DOCUMENTS

| | | | |
|---|---|---|---|
| EP | 2 161 132 | B1 | 4/2011 |
| EP | 2 743 086 | A2 | 6/2014 |
| EP | 3 300 899 | A1 | 4/2018 |
| EP | 3 300 900 | A1 | 4/2018 |
| JP | 2003-11388 | A | 1/2003 |
| JP | 2012-858 | A | 1/2012 |
| JP | 2013-163364 | A | 8/2013 |
| JP | 2015-150701 | A | 8/2015 |
| JP | 2017-52220 | A | 3/2017 |
| JP | 2018-52011 | A | 4/2018 |
| JP | 2018-52016 | A | 4/2018 |
| WO | 2008/056487 | A1 | 2/2010 |

OTHER PUBLICATIONS

International Search Report issued in related International Patent Application No. PCT/JP2018/042443, dated Jan. 15, 2019.

Written Opinion issued in related International Patent Application No. PCT/JP2018/042443, dated Jan. 15, 2019.

Office Action issued in corresponding European Patent Application No. 19183415.9, dated Aug. 3, 2021.

* cited by examiner

LIQUID CARTRIDGE INCLUDING CIRCUIT BOARD AND RESTRICTING SURFACE POSITIONED BELOW LIQUID PASSAGE

CROSS REFERENCE TO RELATED APPLICATION

This application claims priority from Japanese Patent Application No. 2018-162363 filed Aug. 31, 2018. The entire content of the priority application is incorporated herein by reference.

TECHNICAL FIELD

The present disclosure relates to a liquid cartridge storing liquid therein, and a system including the liquid cartridge and an attachment section to which the liquid cartridge is attachable.

BACKGROUND

There is conventionally known a system including an ink cartridge, and an inkjet recording device. The inkjet recording device includes an attachment section, and the ink cartridge can be mounted in and extracted from the attachment section. The attachment section of the inkjet recording device includes electrical contacts and an engaging section engageable with the ink cartridge.

There is also known an ink cartridge provided with a circuit board. A memory is mounted on the circuit board for storing information such as a color, a material composition, and an amount of ink stored in the cartridge. Electrodes are also formed on the circuit board. Electrical connections are established between the electrodes on the ink cartridge and the electrical contacts in the attachment section when the ink cartridge is mounted in the attachment section, so that the inkjet recording device can read the information stored in the memory.

A conventional ink cartridge may also include an engaging surface engageable with the engaging section of the attachment section. In a state where the ink cartridge is attached to the attachment section, the engaging surface is in engagement with the engaging section to keep the ink cartridge held in the attachment section. This engagement prevents the ink cartridge from erroneously popping out of the attachment section (for example, see International Application Publication No. WO2008/056487).

SUMMARY

However, in the device disclosed in the above publication, an ink outlet 7 of the ink cartridge is arranged at a position higher than a vertical center of a leading end surface 11, i.e., at a position adjacent to a circuit board 17 that is also positioned higher than the vertical center. In this structure, in case of ink leakage from the ink outlet 7, the leaked ink may adhere to the circuit board 17. Such ink adhered to the circuit board 17 may bring about failure in electrical connection between the electrodes of the circuit board 17 and the contacts of the attachment section.

In view of the foregoing, it is an object of the present disclosure to provide a liquid cartridge capable of reducing a potential that ink may adhere to a circuit board, and a system including the liquid cartridge.

In order to attain the above and other objects, according to one aspect, the present disclosure provides a liquid cartridge including: a housing; a liquid passage; a sealing member; a circuit board; and a restricting surface. The housing defines a storage chamber therein. The liquid passage extends in a first lateral direction from the housing when the housing is in an operational posture. The liquid passage is in communication with the storage chamber. The sealing member is provided in the liquid passage. The circuit board includes an electrical contact. The electrical contact faces upward when the housing is in the operational posture. The restricting surface is positioned below the liquid passage. The restricting surface is capable of preventing the housing from moving in a second lateral direction opposite the first lateral direction. The liquid passage is positioned closer to the restricting surface than the circuit board is to the restricting surface with respect to a vertical direction perpendicular to the first lateral direction. The circuit board and the restricting surface are positioned further in the second lateral direction relative to the sealing member.

DETAILED DESCRIPTION

Hereinafter, embodiments of the disclosure will be described in detail while referring to accompanying drawings. It would be apparent to those skilled in the art that the embodiments described below are merely examples of the present disclosure and modifications and variations may be made therein without departing from the scope of the disclosure.

First Embodiment

Hereinafter, a first embodiment of the disclosure will be described with reference to FIGS. 1 through 12.

<Overview of Printer 10>

Figure 1:
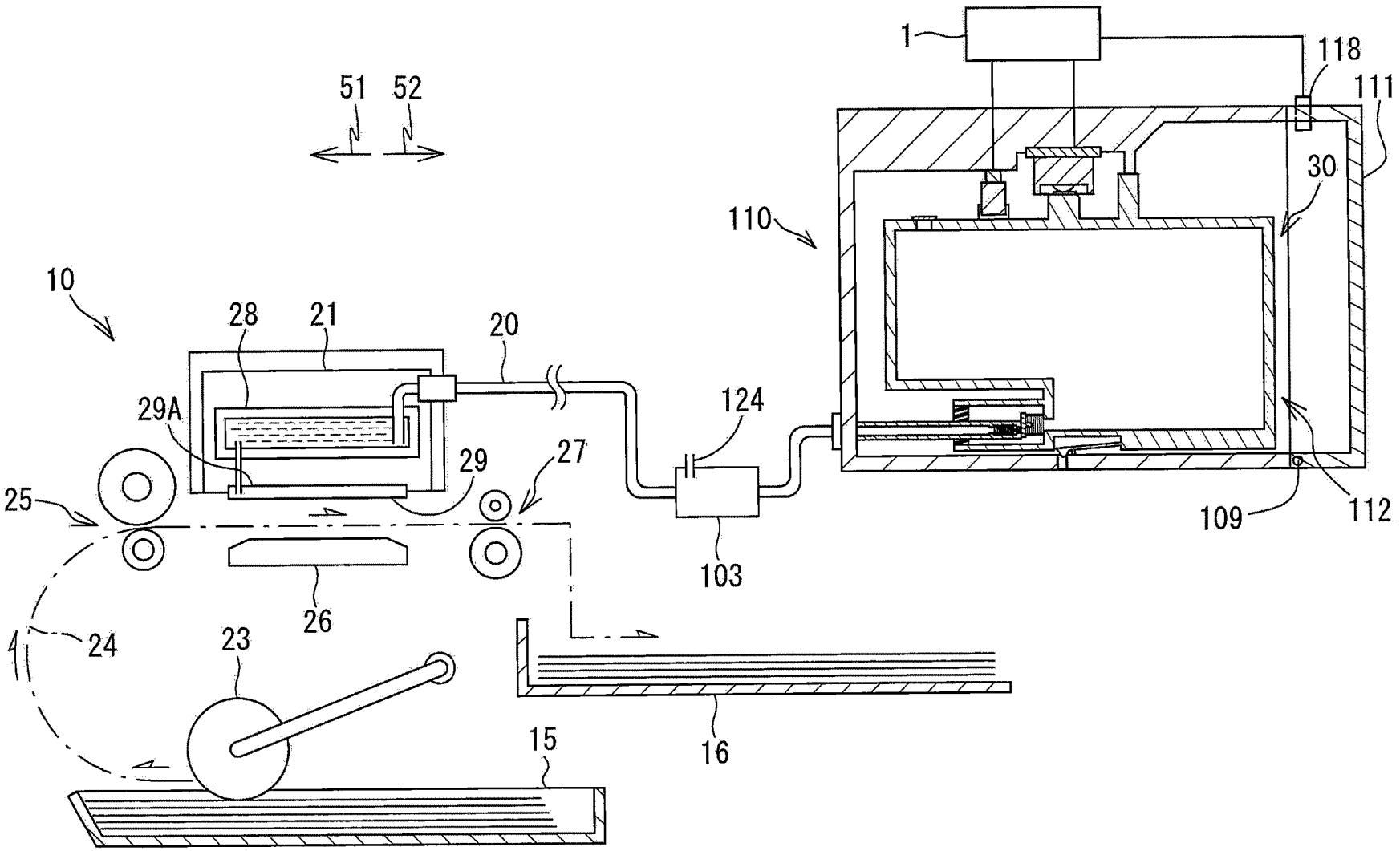
FIG. 1 is a vertical cross-sectional diagram schematically illustrating an internal structure of a printer according to a first embodiment of the disclosure.

As shown in FIG. 1, a printer 10 according to the first embodiment is configured to record images on sheets of paper based on an inkjet recording method of ejecting ink droplets toward the sheets. The printer 10 includes a recording head 21, a cartridge-attachment portion 110, and ink tubes 20. Ink cartridges 30 storing ink to be supplied to the recording head 21 are detachably attachable to the cartridge-attachment portion 110. The ink tubes 20 connect the recording head 21 to the cartridge-attachment portion 110. An opening 112 is formed in one end of the cartridge-attachment portion 110. The ink cartridge 30 and the cartridge-attachment portion 110 constitute a system of the disclosure.

Figure 10:
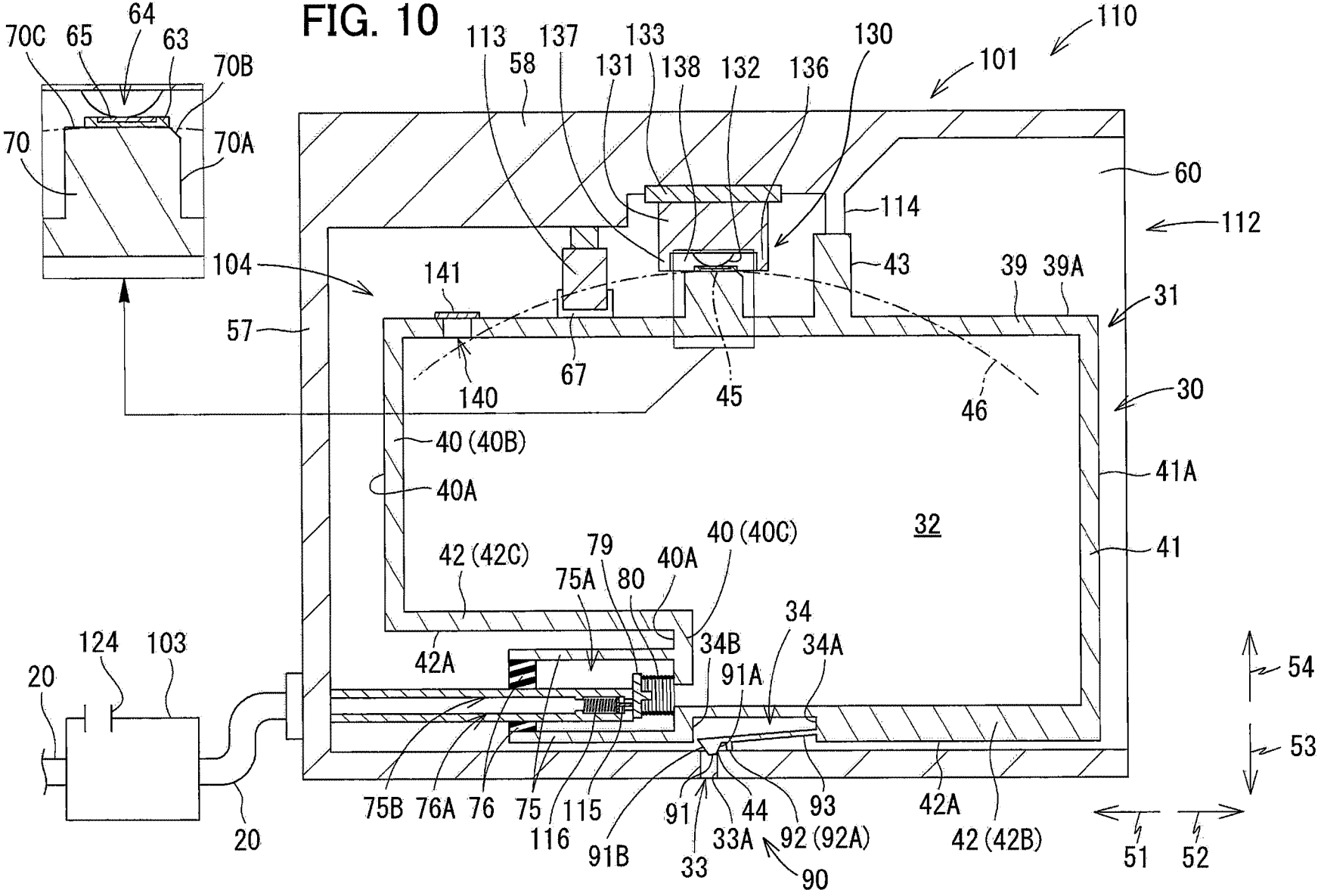
FIG. 10 is a vertical cross-sectional view illustrating a state where the ink cartridge according to the first embodiment is attached to the cartridge-attachment section.

The ink cartridges 30 are inserted into the cartridge-attachment portion 110 through the opening 112 in order to be attached to the cartridge-attachment portion 110. The ink cartridges 30 are also extracted from the cartridge-attachment portion 110 through the opening 112. FIG. 1 shows one of the ink cartridges 30 in its attached state in the cartridge-attachment portion 110, i.e., in a state where the ink cartridge 30 has been completely attached to the cartridge-attachment portion 110. FIG. 10 shows the ink cartridge 30 and cartridge-attachment portion 110 of FIG. 1. That is, FIG. 10 shows the attached state of the ink cartridge 30.

In the following description, a direction in which the ink cartridge 30 is inserted into the cartridge-attachment portion 110 is defined as a frontward direction 51. Further, a posture of the ink cartridge 30 when being inserted forward into and attached to the cartridge-attachment portion 110 is defined as an upright posture. Hence, when in its attached state, the ink cartridge 30 is in the upright posture. FIGS. 1 and 4-10 illustrate the ink cartridge 30 in this upright posture. A rearward direction 52 is defined as a direction opposite the frontward direction 51, and is a direction in which the ink cartridge 30 is extracted from the cartridge-attachment portion 110. In the present embodiment, a horizontal direction is defined as a direction orthogonal to a direction of gravity and parallel to the insertion direction. Both the frontward direction 51 and rearward direction 52 are parallel to the horizontal direction (direction orthogonal to the direction of gravity). The frontward direction 51 and rearward direction 52 cross the direction of gravity. Further, a downward direction 53 is defined as the direction of gravity, and an upward direction 54 is defined as a direction opposite the direction of gravity. Further, as shown in FIGS. 7A-7C, directions orthogonal to the frontward direction 51 and downward direction 53 are defined as a rightward direction 55 and a leftward direction 56, respectively. More specifically, when the ink cartridge 30 is in its upright posture (the attached state shown in FIG. 1), the rightward direction 55 is defined as a direction extending rightward and the leftward direction 56 as a direction extending leftward when the ink cartridge 30 is viewed from the rear, as illustrated in FIG. 7A.

Further, in the following description, the frontward direction 51 and rearward direction 52 will be collectively referred to as a front-rear direction, the upward direction 54 and downward direction 53 are collectively referred to as a vertical direction, and the rightward direction 55 and leftward direction 56 are collectively referred to as a left-right direction.

In the state where the ink cartridge 30 is completely attached to the cartridge-attachment portion 110, the ink cartridge 30 has a height in the vertical direction (i.e., height direction); a depth in the front-rear direction (i.e., depth direction); and a width in the left-right direction (i.e., widthwise se direction).

When the ink cartridge 30 is in its upright posture, the width direction of the ink cartridge 30 corresponds to the left-right direction, the height direction of the ink cartridge 30 corresponds to the vertical direction, and the depth direction of the ink cartridge 30 corresponds to the front-rear direction.

The ink cartridge 30 is inserted forward into the cartridge-attachment portion 110 through the opening 112 (see FIGS. 8 and 9) while being in the upright posture, and is attached to the cartridge-attachment portion 110 (see FIG. 10). The ink cartridge 30 is extracted rearward from the cartridge-attachment portion 110 while being in the upright posture.

Each ink cartridge 30 stores ink that the printer 10 can use for printing. As shown in FIG. 1, each ink cartridge 30 is connected to the recording head 21 by the corresponding ink tube 20 when the ink cartridge 30 is in its attached state in the cartridge-attachment portion 110. The recording head 21 includes sub-tanks 28, and nozzles 29. Each of the sub-tanks 28 temporarily holds ink to be supplied through the corresponding ink tube 20. The recording head 21 ejects ink supplied from the sub-tanks 28 through the nozzles 29 according to an inkjet recording method. More specifically, the recording head 21 includes a head control board (not shown), and piezoelectric elements 29A corresponding one-on-one to the nozzles 29. The head control board selectively applies drive voltages to the piezoelectric elements 29A in order to eject ink from the nozzles 29.

In the attached state of the ink cartridges 30 to the cartridge-attachment portion 110, the ink in each ink cartridge 30 can be used for printing by the recording head 21 in the printer 10. Hence, hereinafter, the posture of each ink cartridge 30 in its attached state to the cartridge-attachment portion 110 may also be called as "operational posture", as appropriate.

The printer 10 also includes a sheet tray 15, a feed roller 23, a conveying path 24, a pair of conveying rollers 25, a platen 26, a pair of discharge rollers 27, and a discharge tray 16. The feed roller 23 feeds each of the sheets from the sheet tray 15 onto the conveying path 24, and the conveying rollers 25 convey the sheet onto the platen 26. The recording head 21 ejects ink onto the sheet as the sheet passes over the platen 26, whereby an image is recorded on the sheet. The discharge rollers 27 receive the sheet that has passed over the platen 26 and discharge the sheet into the discharge tray 16 provided on a downstream end of the conveying path 24.

<Cartridge-Attachment Portion 110>

Figure 2:
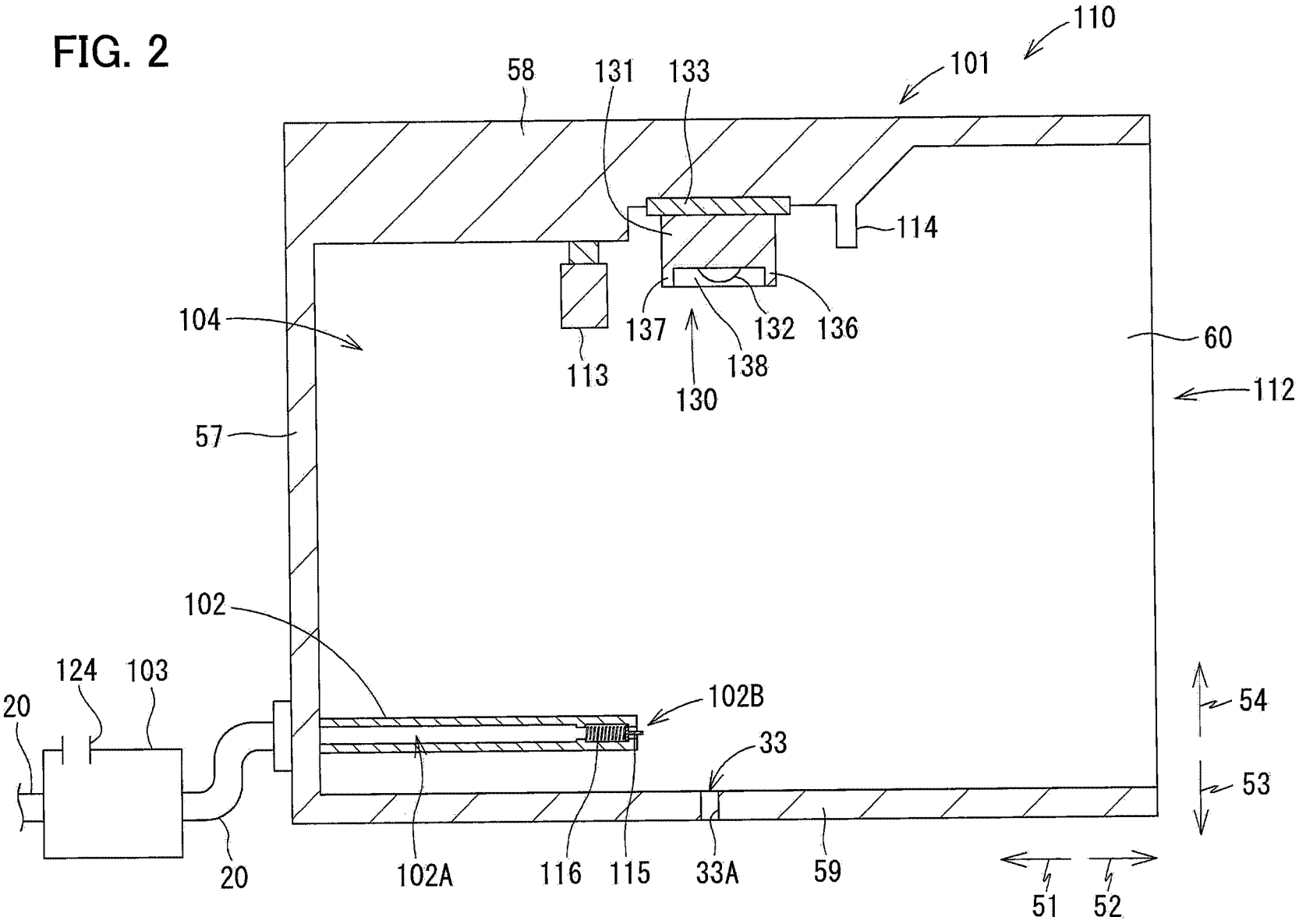
FIG. 2 is a vertical cross-sectional view of a cartridge-attachment section of the printer according to the first embodiment.

As shown in FIG. 2, the cartridge-attachment portion 110 includes a cartridge holder 101, a cover 111, a cover sensor 118, and four sets of tubes 102, tanks 103, optical sensors 113, protruding parts 114, and connectors 130.

<Cartridge Holder 101>

The cartridge holder 101 shown in FIG. 2 constitutes a housing of the cartridge-attachment portion 110. The cartridge holder 101 has a box shape. An interior space 104 is formed inside the cartridge holder 101.

As shown in FIG. 2, the cartridge holder 101 includes an end wall 57, a bottom wall 59, a top wall 58, and a pair of side walls 60. The bottom wall 59 extends rearward from a bottom edge of the end wall 57. The top wall 58 extends rearward from a top edge of the end wall 57 and is separated vertically from the bottom wall 59. The side walls 60 extend rearward from respective right and left edges of the end wall 57. The side wall 60 extending from the right edge of the end wall 57 is connected to right edges of the bottom wall 59 and top wall 58, while the side wall 60 extending from the left edge of the end wall 57 is connected to left edges of the bottom wall 59 and top wall 58. Hence, the side walls 60 are separated from each other in the left-right direction and respectively connect the top wall 58 to the bottom wall 59.

The bottom wall 59 is formed with a depressed portion 33. The depressed portion 33 is recessed downward from an upper surface of the bottom wall 59. In the present embodiment, the depressed portion 33 is a through-hole penetrating vertically through a thickness of the bottom wall 59. However, the depressed portion 33 may not necessarily penetrate through the bottom wall 59. The depressed portion 33 is positioned further rearward than the corresponding tube 102.

An end of the cartridge holder 101 opposite the end wall 57 in the front-rear direction is open serving as the opening 112. The opening 112 is in communication with the interior space 104 of the cartridge holder 101. A user faces the opening 112 when using the printer 10.

The interior space 104 of the cartridge holder 101 is defined by the end wall 57, bottom wall 59, top wall 58, and side walls 60. Partitioning walls (not shown) partition the interior space 104 into four compartments. One each of the tubes 102, tanks 103, optical sensors 113, protruding parts 114, and connector 130 is provided in each compartment of the interior space 104. Note that the number of compartments in the interior space 104 is not limited to four.

<Cover 111>

As shown in FIG. 1, the cover 111 is provided near the opening 112 formed in the cartridge holder 101. The cover 111 is capable of covering the opening 112 or exposing the opening 112 to the outside by closing and opening on the cartridge holder 101. The cover 111 is supported on a pivot shaft 109 that extends in the left-right direction near a portion of the cartridge holder 101 defining a bottom edge of the opening 112. With this construction, the cover 111 is capable of pivoting from a closed position (see FIG. 1) for covering the opening 112 to an open position so that a top edge of the cover 111 moves forward. When the cover 111 is in the open position, the user can insert ink cartridges 30 into the cartridge holder 101 through the opening 112 formed in the cartridge holder 101. When the cover 111 is in the closed position, the user cannot insert ink cartridges 30 into or extract ink cartridges 30 from the cartridge holder 101.

<Cover Sensor 118>

As shown in FIG. 1, the cover sensor 118 is disposed on the cartridge holder 101 near the top edge of the opening 112. The cover sensor 118 includes a light-emitting part and a light-receiving part. When the cover 111 is in the closed position, a part of the cover 111 is disposed in an optical path of the light traveling from the light-emitting part toward the light-receiving part, blocking the light from reaching the light-receiving part in the cover sensor 118. Accordingly, the cover sensor 118 outputs a low level signal to a controller 1 (see FIG. 1). When the cover 111 is not in the closed position, that is, when the cover 111 is separated from the cover sensor 118, the cover 111 does not interrupt the light traveling from the light-emitting part to the light-receiving part. The cover sensor 118 thus outputs a high level signal to the controller 1.

<Tubes 102>

Each tube 102 shown in FIG. 2 is a hollow cylindrical-shaped member formed of a resin. As shown in FIG. 2, the tubes 102 are located in a lower portion of the end wall 57 constituting the cartridge holder 101. The tubes 102 protrude farther rearward than the end wall 57 of the cartridge holder 101. A rear end (distal end) and a front end (proximal end) of each tube 102 are both open.

Each tube 102 has an interior space 102A therein. A valve 115 and a coil spring 116 are accommodated in each interior space 102A. By moving in the front-rear direction, the valve 115 opens and closes an opening 102B formed in the distal end of the tube 102. The coil spring 116 urges the valve 115 rearward. Hence, in a state where no external force is applied to the valve 115 (when the ink cartridge 30 is not mounted in the cartridge-attachment portion 110), the valve 115 closes the opening 102B. When no external force is applied to the valve 115, a rear end of the valve 115 urged by the coil spring 116 protrudes out of the opening 102B to extend further rearward than the opening 102B.

Notches (not shown) are formed in a peripheral wall of each tube 102 at a distal end thereof, and specifically in a portion of the peripheral wall positioned rearward from a part of the valve 115 that closes the opening 102B, i.e., a front end of the valve 115.

<Tanks 103>

As shown in FIG. 2, the tanks 103 are provided frontward of the cartridge holder 101. Each tank 103 has a box shape that allows ink to be stored therein. Each tank 103 has a top portion that is open to the outside through an air communication port 124. Accordingly, an interior space of the tank 103 is in communication with the atmosphere. The interior space in the tank 103 is in communication with the front end of the corresponding tube 102 via the corresponding ink tube 20. With this arrangement, ink flowing out of the interior space 102A of the tube 102 is accumulated in the tank 103. The interior space of the tank 103 is also in communication with the recording head 21 through the corresponding ink tube 20. Accordingly, ink stored in the internal space of the tank 103 is supplied to the recording head 21 through the corresponding ink tube 20.

Note that the cartridge-attachment portion 110 need not be provided with the tanks 103. In this case, the front ends of the tubes 102 communicate with the recording head 21 via the ink tubes 20 without passing through the tanks 103.

<Optical Sensors 113>

As shown in FIG. 2, the optical sensors 113 are disposed near the top wall 58 of the cartridge holder 101. Each optical sensor 113 includes a light-emitting part and a light-receiving part. The light-emitting part is disposed on the right or left of the light-receiving part and is spaced away from the light-receiving part.

The optical sensors 113 are configured to output detection signals to the controller 1. The signals differ depending on whether the light-receiving parts receive light emitted from the corresponding light-emitting parts. For example, the optical sensor 113 may output a low level signal to the controller 1 when the light-receiving part cannot receive light emitted from the corresponding light-emitting part (that is, when the received light is less than a prescribed intensity); and the optical sensor 113 may output a high level signal to the controller 1 when the light-receiving part can receive light emitted from the corresponding light-emitting part (that is, when the received light is greater than or equal to the prescribed intensity). Here, the controller 1 is a device for controlling overall operations of the printer 10 and is configured of a CPU, ROM, and RAM, for example.

<Protruding Parts 114>

As shown in FIG. 2, the protruding parts 114 protrude downward from the top wall 58 of the cartridge holder 101. The protruding parts 114 are disposed rearward of the respective optical sensors 113 in the front-rear direction.

<Connectors 130>

Figure 3A:
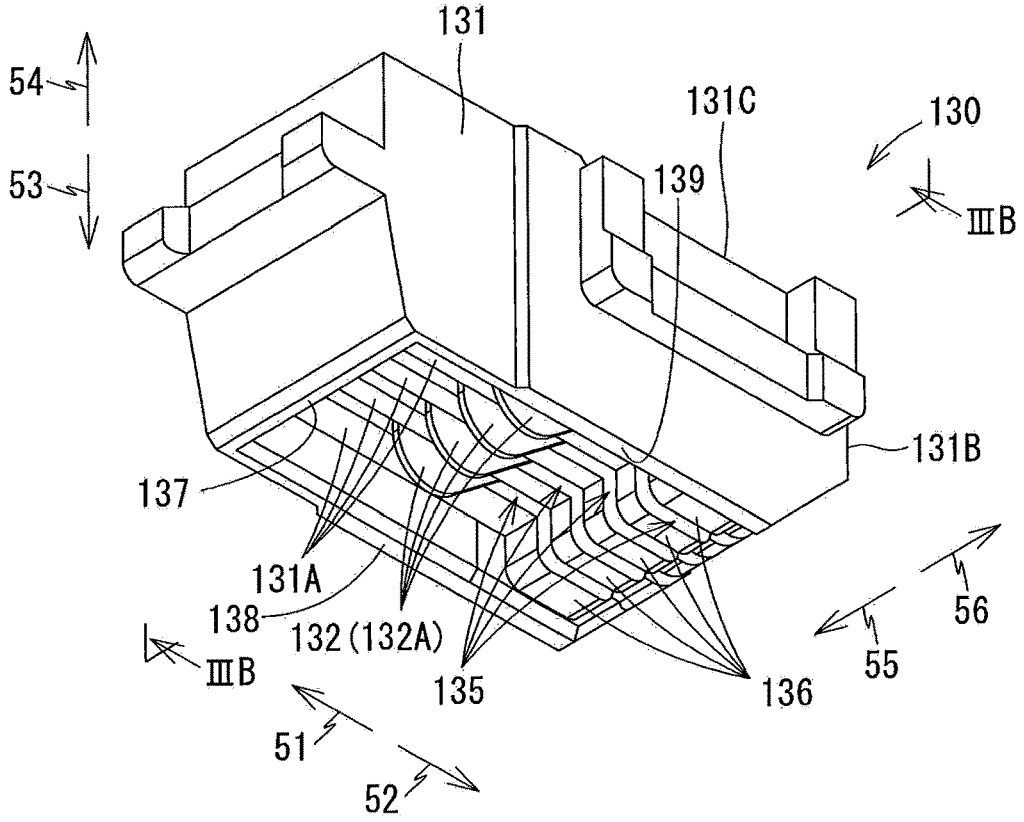
FIG. 3A is a perspective view of a connector of the cartridge-attachment section according to the first embodiment.
Figure 3B:
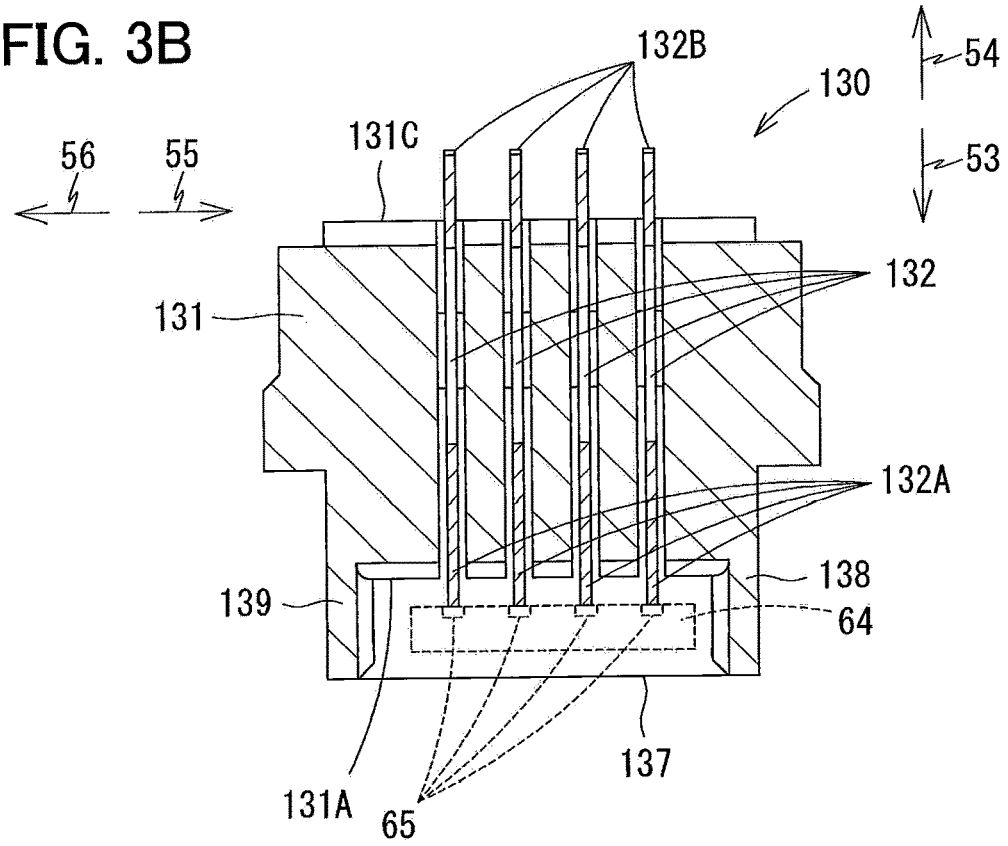
FIG. 3B is a cross-sectional view of the connector according to the first embodiment taken along a plane IIIB-IIIB shown in FIG. 3A.

As shown in FIGS. 2 through 3B, each connector 130 includes four contacts 132, and a case 131 accommodating the four contacts 132.

As shown in FIG. 2, a circuit board 133 is fixed to the cartridge holder 101 near the top wall 58. The circuit board 133 is positioned farther rearward than the tubes 102 and optical sensors 113 and farther forward than the protruding parts 114. The circuit board 133 is fixed to the cartridge holder 101. The cases 131 of the connectors 130 are fixed to a bottom surface of the circuit board 133 with screws, solder, or the like (not shown). Hence, the connectors 130 are fixed to the cartridge holder 101 via the circuit board 133. Note that the connectors 130 need not be fixed to the cartridge holder 101. For example, the connectors 130 may be removably fitted into or otherwise attached to the bottom surface of the circuit board 133.

As shown in FIGS. 3A and 3B, the case 131 of each connector 130 has a generally rectangular parallelepiped shape. Slots 135 are formed in the case 131 to span from a bottom surface 131A to a top surface 131C via a rear surface 131B. Four of the slots 135 are formed at intervals in the left-right direction. The four slots 135 provide four internal spaces in the case 131. One each of the contacts 132 is disposed in each of the four internal spaces. Thus, the connector 130 includes four contacts 132. Note that the number of slots 135 is not limited to four, and thus the number of contacts 132 provided in the connector 130 is not limited to four, either.

The contacts 132 are supported by the case 131 each in the internal space formed by the corresponding slot 135. The contacts 132 are configured of members that are flexible and electrically conductive. Bottom end portions 132A of the contacts 132 protrude farther downward than the bottom surface 131A of the case 131. The bottom end portions 132A of the contacts 132 are resiliently deformable upward.

Top end portions 132B of the contacts 132 (see FIG. 3B) are mounted on the circuit board 133. Through this construction, the contacts 132 are electrically connected to an electrical circuit mounted on the circuit board 133. In other words, the contacts 132 are electrically connected to the electrical circuit. The electrical circuit is also electrically connected to the controller 1 (see FIG. 1).

The case 131 includes a rear wall 136, a front wall 137, a right wall 138, and a left wall 139. The rear wall 136, front wall 137, right wall 138, and left wall 139 protrude downward from the bottom surface 131A of the case 131. Bottom edges of the rear wall 136, front wall 137, right wall 138, and left wall 139 are positioned lower than bottom edges of the contacts 132.

The rear wall 136 is positioned farther rearward than the bottom end portions 132A of the contacts 132. The front wall 137 is positioned farther forward than the bottom end portions 132A of the contacts 132. The rear wall 136 and front wall 137 are aligned with each other in the front-rear direction. The right wall 138 is positioned farther rightward than the bottom end portions 132A of the contacts 132, and the left wall 139 is positioned farther leftward than the bottom end portions 132A of the contacts 132. The right wall 138 and left wall 139 are aligned with each other in the left-right direction. A front edge of the right wall 138 is connected to a right edge of the front wall 137, and a rear edge of the right wall 138 is connected to a right edge of the rear wall 136. A front edge of the left wall 139 is connected to a left edge of the front wall 137, and a rear edge of the left wall 139 is connected to a left edge of the rear wall 136.

<Ink Cartridge 30>

The ink cartridge 30 shown in FIGS. 4 to 7C is a container for storing ink. One ink cartridge 30 can be accommodated in each of the four compartments partitioned in the interior space 104 of the cartridge holder 101 (see FIG. 2). Thus, four ink cartridges 30 can be accommodated in the cartridge-attachment portion 110 in the present embodiment. Each of the four ink cartridges 30 corresponds to one of the ink colors of cyan, magenta, yellow, and black. Ink in one of these four colors is stored in the corresponding ink cartridge 30. The number of ink cartridges 30 that the cartridge-attachment portion 110 can accommodate is not limited to four.

Unless otherwise specified, hereinafter, the ink cartridge 30 is assumed to be in its upright posture (operational posture). In other words, the vertical, front-rear, and left-right directions for the ink cartridge 30 are defined based on the ink cartridge 30 in the upright posture (operational posture).

As shown in FIGS. 4 to 7C, each ink cartridge 30 includes a housing 31, a sealing member 76, a protruding part 43, a projection 67, a resilient member 90, a raised portion 70, and a circuit board 64.

<Housing 31>

The housing 31 includes a front wall 40, a rear wall 41, a top wall 39, a bottom wall 42, and a pair of side walls 37 and 38. The front wall 40 and rear wall 41 are separated from each other in the front-rear direction. The top wall 39 is arranged between the front wall 40 and rear wall 41 and extends from a top edge of the front wall 40 to a top edge of the rear wall 41. The bottom wall 42 is arranged between the front wall 40 and rear wall 41 and extends from a bottom edge of the front wall 40 to a bottom edge of the rear wall 41. That is, each of the top wall 39 and bottom wall 42 connects the front wall 40 to the rear wall 41. The top wall 39 and bottom wall 42 are spaced away from each other in the direction of gravity. The side wall 37 and side wall 38 are separated from each other in the left-right direction. Peripheral edges of the side walls 37 and 38 are connected to the front wall 40, rear wall 41, top wall 39, and bottom wall 42, respectively.

In a state where the ink cartridge 30 is in its upright posture, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56. Also in the upright posture, a front surface 40A of the front wall 40 faces forward, a rear surface 41A of the rear wall 41 faces rearward, a bottom surface 42A of the bottom wall 42 faces downward, a top surface 39A of the top wall 39 faces upward, a right surface 37A of the side wall 37 faces rightward, and a left surface 38A of the side wall 38 faces leftward.

The front wall 40 is configured of a front wall 40B, and a front wall 40C positioned farther rearward than the front wall 40B. That is, a front surface of the front wall 40B and a front surface of the front wall 40C constitute the front surface 40A of the front wall 40.

The bottom wall 42 is configured of a bottom wall 42B, and a bottom wall 42C positioned higher than the bottom wall 42B. A bottom surface of the bottom wall 42B and a bottom surface of the bottom wall 42C constitute the bottom surface 42A of the bottom wall 42. The bottom wall 42C extends continuously rearward from a bottom edge of the front wall 40B. The bottom wall 42B and bottom wall 42C are joined through the front wall 40C.

The ink cartridge 30 has an overall flattened shape in which a left-right dimension thereof (width) is smaller than a front-rear dimension thereof (depth), and the vertical and front-rear dimensions (height and depth) are greater than the left-right dimension (width).

The ink cartridge 30 is configured to be attached to the cartridge holder 101 by inserting the ink cartridge 30 forward through the opening 112 formed in the cartridge holder 101 of the cartridge-attachment portion 110. The ink cartridge 30 is configured to be removed from the cartridge holder 101 by pulling the ink cartridge 30 rearward through the opening 112.

Figure 6:
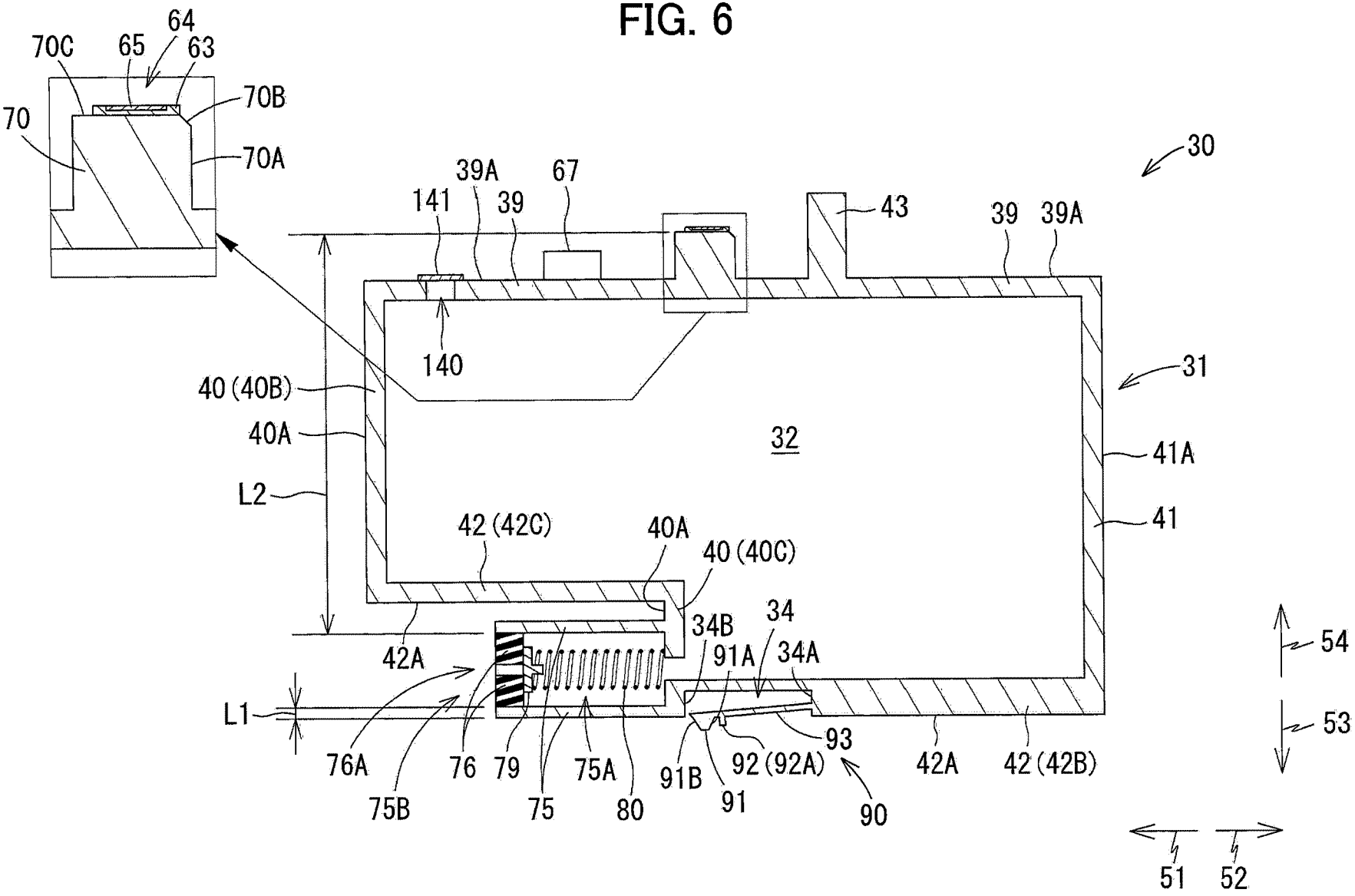
FIG. 6 is a vertical cross-sectional view of the ink cartridge according to the first embodiment in the upright posture.
Figure 7A:
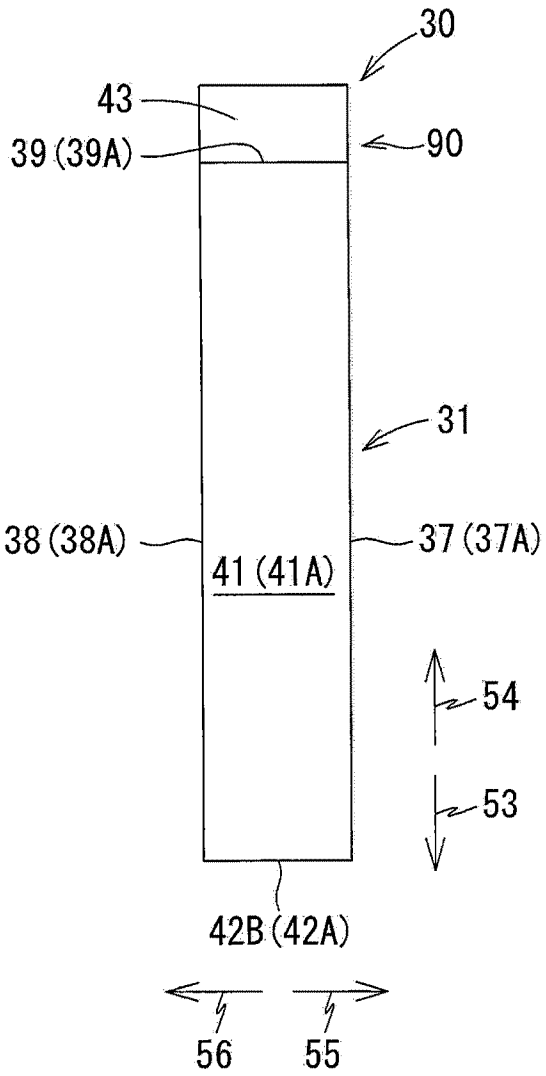
FIG. 7A is a rear side view of the ink cartridge according to the first embodiment in the upright posture.
Figure 7B:
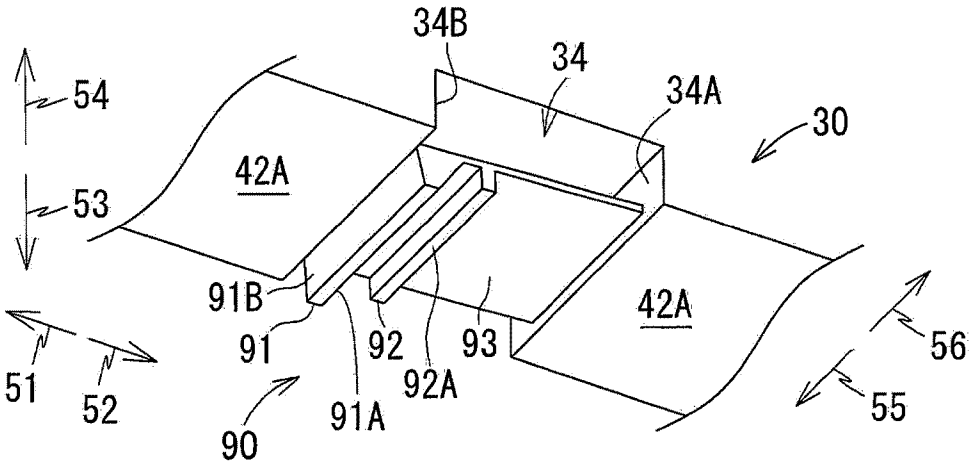
FIG. 7B is a perspective view illustrating a structure in the vicinity of a resilient member in the ink cartridge according to the first embodiment in the upright posture.
Figure 7C:
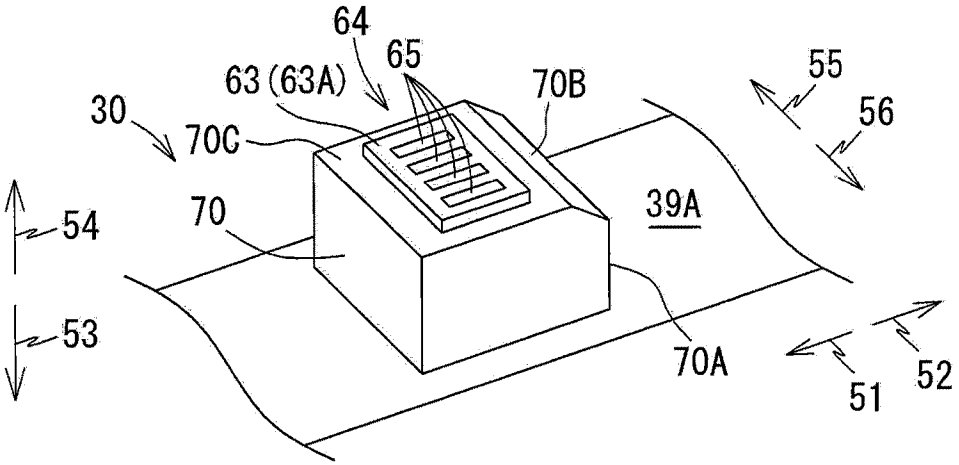
FIG. 7C is a perspective view illustrating a structure near a circuit board of the ink cartridge according to the first embodiment in the upright posture.

As shown in FIG. 6, the housing 31 defines therein a storage chamber 32 for storing ink. The storage chamber 32 is positioned between the front wall 40 and rear wall 41, between the top wall 39 and bottom wall 42, and between the pair of side walls 37 and 38. In the present embodiment, the storage chamber 32 is defined by a surface of the front wall 40 opposite the front surface 40A (a rear surface of the front wall 40), a surface of the rear wall 41 opposite the rear surface 41A (a front surface of the rear wall 41), a surface of the top wall 39 opposite the top surface 39A (a lower surface of the top wall 39), a surface of the bottom wall 42 opposite the bottom surface 42A (an upper surface of the bottom wall 42), a surface of the side wall 37 opposite the right surface 37A (a left surface of the side wall 37), and a surface of the side wall 38 opposite the left surface 38A (a right surface of the side wall 38).

In the housing 31, at least the rear wall 41 is capable of transmitting light so that a level of ink stored in the storage chamber 32 is visible from the outside of the housing 31.

The housing 31 also includes a cylinder 75 that protrudes forward from the front surface 40A of the front wall 40C. The cylinder 75 extends in the front-rear direction. The cylinder 75 defines therein a passage 75A extending in the front-rear direction. That is, the direction in which the cylinder 75 and passage 75A extend from the housing 31 (i.e., the frontward direction 51) coincides with the insertion direction of the ink cartridge 30. An opening 75B is formed in a front end of the cylinder 75 and in communication with the passage 75A. The passage 75A has a rear end in communication with the storage chamber 32. That is, the passage 75A is provided at the front wall 40C to be open frontward. In other words, the passage 75A penetrates through the front wall 40 in the front-rear direction and provides communication between the storage chamber 32 and the outside of the housing 31.

The passage 75A accommodates therein a valve 79, and a coil spring 80. The valve 79 is movable in the front-rear direction to open and close the opening 75B. The coil spring 80 urges the valve 79 frontward. Therefore, in a state where no external force is applied to the valve 79, the valve 79 firmly contacts the sealing member 76 fitted in the opening 75B. When an external force is applied to the valve 79, the valve 79 is separated from the sealing member 76, thereby allowing ink stored in the storage chamber 32 to be supplied to the outside of the housing 31, through the passage 75A and the opening 75B. Incidentally, a structure for switching between opening and closing of the opening 75B is not limited to the structure configured of the valve 79. For example, the opening 75B may be closed by a seal affixed to the cylinder 75.

An air communication port 140 is formed in the top wall 39 of the housing 31. A seal 141 seals the air communication port 140 prior to insertion of the ink cartridge 30 into the cartridge-attachment portion 110. The seal 141 can be peeled off the air communication port 140. By peeling the seal 141 off the air communication port 140 before insertion of the ink cartridge 30 into the cartridge-attachment portion 110, the storage chamber 32 is able to communicate with an ambient air via the air communication port 140.

Incidentally, the storage chamber 32 may be communicated with the ambient air through means not involving peeling off of the seal 141. For example, a valve may be provided in the air communication port 140 so as to realize switching of a status of the storage chamber 32 between a communication state in communication with the ambient air and a non-communication state out of communication with the ambient air.

Incidentally, the front wall 40, rear wall 41, top wall 39, bottom wall 42, and side walls 37 and 38 each may be configured of a plurality of walls in the same manner as the front wall 40 in the embodiment, or each may be configured of a single wall just like the rear wall 41.

Still alternatively, the surfaces of the ink cartridge 30 including the front surface 40A of the front wall 40, rear surface 41A of the rear wall 41, top surface 39A of the top wall 39, bottom surface 42A of the bottom wall 42, right surface 37A of the side wall 37, and left surface 38A of the side wall 38 need not be formed as single flat surfaces, respectively.

The front surface 40A of the front wall 40 is a surface of the housing 31 that the user can see when the ink cartridge 30 in its upright posture is viewed from the front side. According to a concept of the present disclosure, a front surface includes: a surface of the housing 31 positioned farthest forward (the front surface 40A); and a surface positioned forward of a halfway point in the front-rear direction between the forwardmost surface and a rearmost surface of the housing 31 (the rear surface 41A).

The rear surface 41A of the rear wall 41 is a surface of the housing 31 that the user can see when the ink cartridge 30 in its upright posture is viewed from the rear side. The concept of a rear surface in the present disclosure includes: a surface of the housing 31 positioned farthest rearward (the rear surface 41A); and a surface positioned rearward of the halfway point in the front-rear direction between the rearmost surface and the forwardmost surface of the housing 31 (front surface 40A).

The top surface 39A of the top wall 39 is a surface of the housing 31 that the user can see when the ink cartridge 30 in its upright posture is viewed from above. The concept of the top surface in the present disclosure includes: a topmost surface of the housing 31 (the top surface 39A); and a surface above a vertical halfway point between this topmost surface and a bottommost surface of the housing 31 (the bottom surface 42A).

The bottom surface 42A of the bottom wall 42 is a surface of the housing 31 that the user can see when the ink cartridge 30 in its upright posture is viewed from below. The concept of the bottom surface in the present disclosure includes: the bottommost surface of the housing 31 (the bottom surface 42A); and a surface below the vertical halfway point between this bottommost surface and the topmost surface of the housing 31 (the top surface 39A).

The right surface 37A of the side wall 37 is a surface of the housing 31 that the user can see when the ink cartridge 30 in its upright posture is viewed from the right side.

The left surface 38A of the side wall 38 is a surface of the housing 31 that the user can see when the ink cartridge 30 in its upright posture is viewed from the left side.

<Sealing Member 76>

As illustrated in FIG. 6, the sealing member 76 is disposed in the passage 75A. The sealing member 76 is configured of an elastic member formed of rubber or the like. The sealing member 76 is a ring-shaped member with a through-hole 76A formed in a center thereof. The through-hole 76A has a circular shape in cross-section. The through-hole 76A has a diameter smaller than an outer diameter of the corresponding tube 102 in the cartridge-attachment portion 110 (see FIG. 2). As shown in FIG. 6, the sealing member 76 is disposed near the opening 75B of the cylinder 75 so that the through-hole 76A is at the same position as the opening 75B in the front-rear direction. The sealing member 76 has an outer diameter larger than a diameter of the opening 75B. Accordingly, when the sealing member 76 is fitted in the opening 75B, a hermetic seal is formed between the sealing member 76 and the cylinder 75 to provide a light-tight seal therebetween.

The sealing member 76 is prevented from coming off the cylinder 75 by well-known means. For example, the sealing member 76 may be fixed in the cylinder 75 by nipping the sealing member 76 between the cylinder 75 and a cap (not shown) placed over the cylinder 75, or may be fixed in the cylinder 75 by adhesive.

<Protruding Part 43>

Figure 4:
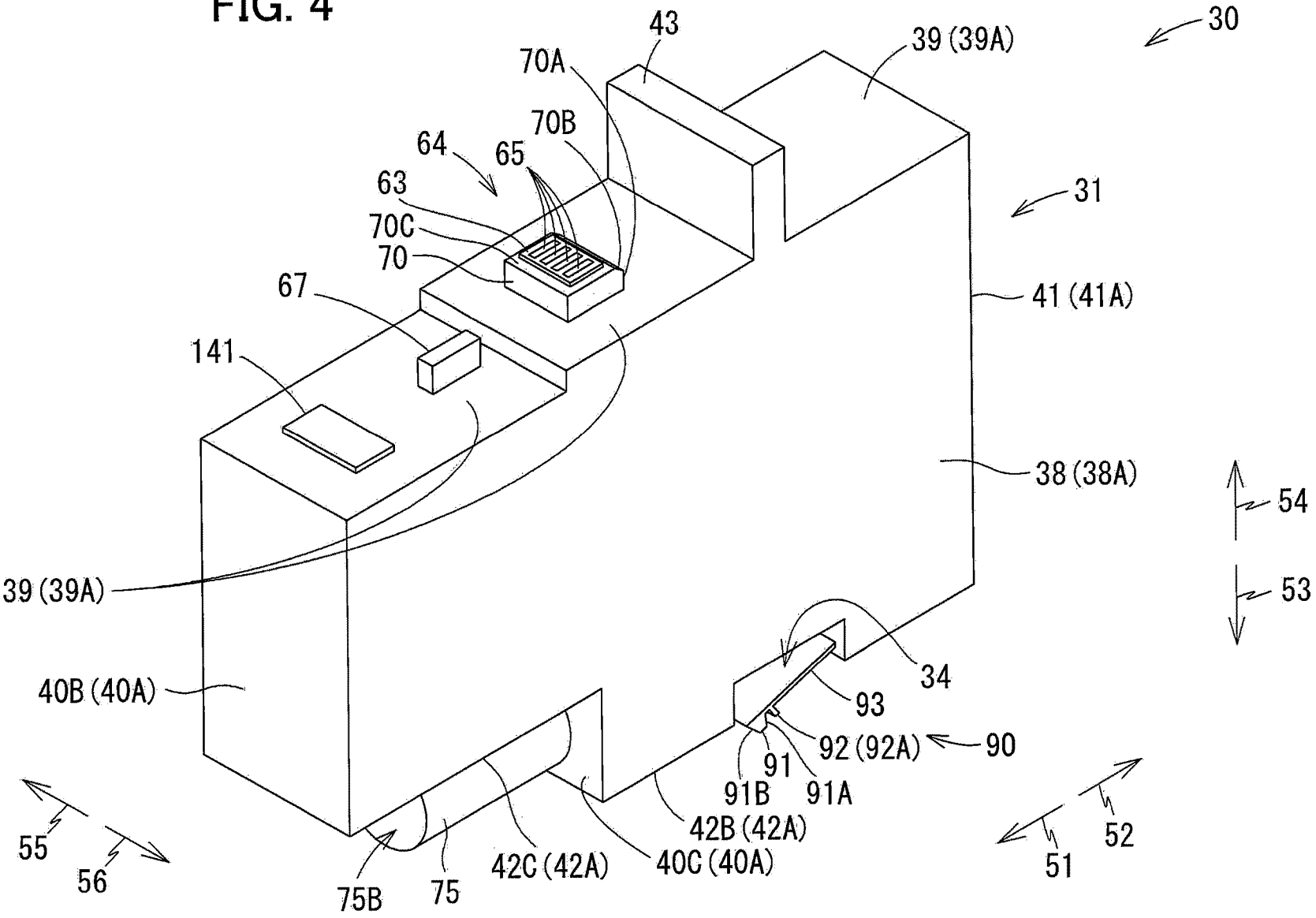
FIG. 4 is a perspective view of an ink cartridge according to the first embodiment in an upright posture as viewed from above.

As illustrated in FIGS. 4 and 6, the protruding part 43 is provided on a rear portion of the top surface 39A of the top wall 39.

<Projection 67>

As illustrated in FIGS. 4 and 6, the projection 67 is provided on the top surface 39A of the top wall 39. The projection 67 protrudes upward from the top surface 39A and is elongated in the front-rear direction. The projection 67 is positioned forward of the protruding part 43.

Light emitted by the optical sensor 113 of the cartridge-attachment portion 110 (see FIG. 2) is configured to be incident on either a right surface or a left surface of the projection 67. Hence, the surface of the projection 67 on which light is incident will be called a "light-blocking surface". In the present embodiment, the projection 67 is a plate formed of a resin material that contains a color material (black pigment) capable of blocking or attenuating light, for example. As a variation, a material that prevents passage of light such as aluminum foil may be affixed to at least the light-blocking surface of the projection 67.

<Resilient Member 90>

Figure 5:
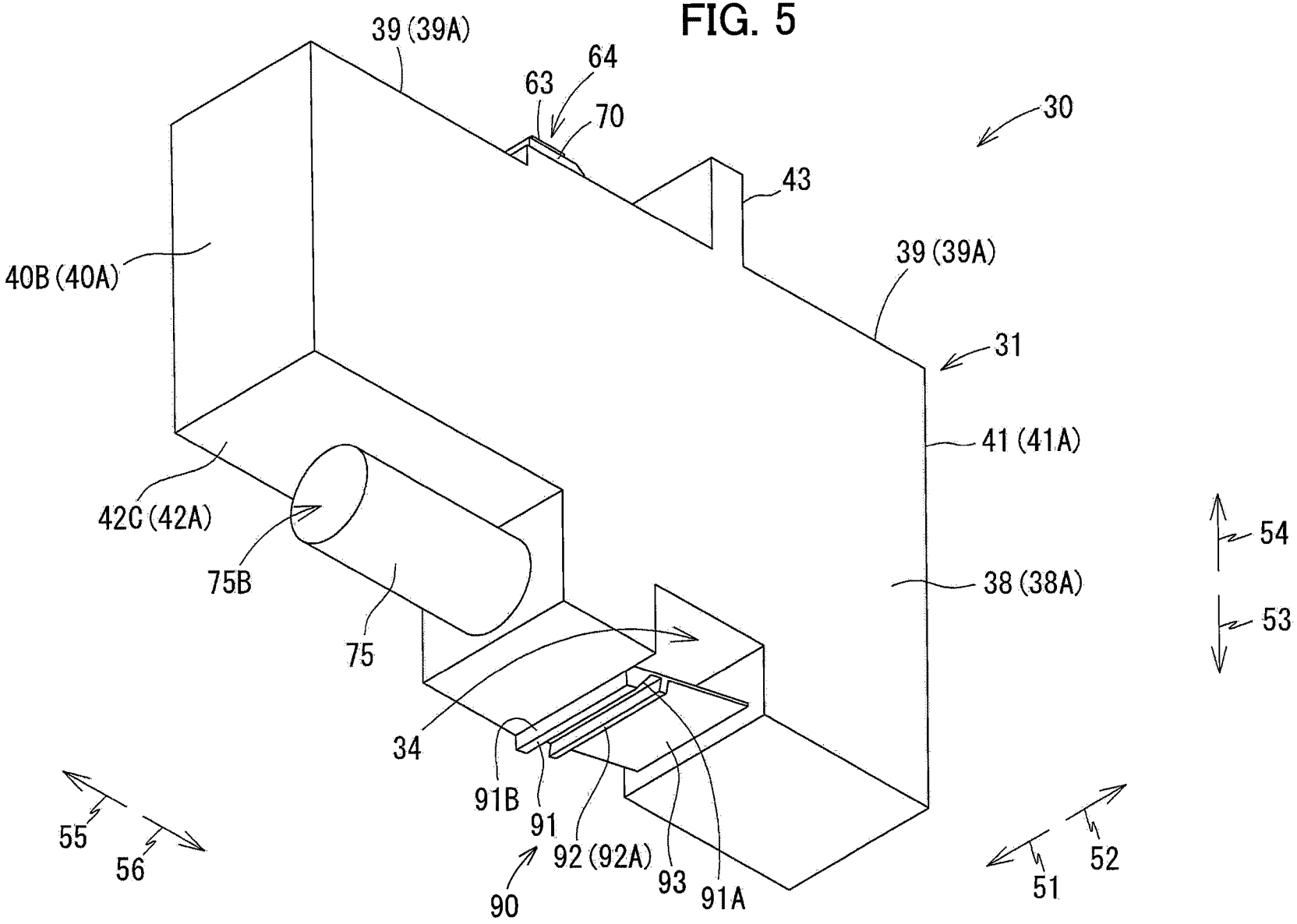
FIG. 5 is a perspective view of the ink cartridge according to the first embodiment in its upright posture as viewed from below.

As depicted in FIGS. 5, 6 and 7B, the housing 31 includes a recess 34 formed in the bottom wall 42. The recess 34 is recessed upward from the bottom surface 42A. The recess 34 is positioned rearward of the cylinder 75. The resilient member 90 is provided to protrude generally forward from a side surface 34A of the recess 34, the side surface 34A facing frontward and defining part of the recess 34. More specifically, the resilient member 90 protrudes from the side surface 34A to extend downward toward the front. Thus, the resilient member 90 is inclined relative to the bottom surface 42A.

The resilient member 90 includes a main body 93, a first protrusion 91, and a second protrusion 92. The main body 93 extends forward and downward from the side surface 34A of the recess 34. The first protrusion 91 protrudes downward from a free end portion (front end portion) of the main body 93. The first protrusion 91 has a generally triangular shape in a side view. The first protrusion 91 has a rear surface 91A sloping upward toward the rear. The first protrusion 91 has a front surface 91B sloping downward toward the rear. The front surface 91B has an upper edge positioned within the recess 34.

The second protrusion 92 protrudes downward from the main body 93 at a position between the first protrusion 91 and a proximal end portion (rear end portion) of the main body 93. The second protrusion 92 has a bottom surface 92A facing generally downward. The second protrusion 92 has a protruding length smaller than a protruding length of the first protrusion 91. That is, a lower end of the first protrusion 91 is positioned lower than a lower end (bottom surface 92A) of the second protrusion 92.

Incidentally, the resilient member 90 may protrude from a surface other than the side surface 34A. For example, the resilient member 90 may protrude from a side surface 34B of the recess 34 (the surface facing rearward, see FIG. 6) to extend diagonally rearward and downward.

The rear surface 91A of the first protrusion 91 is positioned lower than the passage 75A of the cylinder 75. The rear surface 91A is positioned rearward relative to the sealing member 76. Further, with regard to the vertical direction, the rear surface 91A and the passage 75A define therebetween a distance L1 (shortest distance) that is smaller than a distance L2 (shortest distance) defined between the passage 75A and the circuit board 64. That is, the passage 75A is positioned closer to the rear surface 91A of the first protrusion 91 than to the circuit board 64 in the vertical direction.

The resilient member 90 is resiliently deformable. In the present embodiment, the resilient member 90 is a leaf spring whose dimension in the front-rear direction is greater than a dimension thereof in the vertical direction. The resilient member 90 is configured to resiliently deform upon application of an external force thereon, so that a front end portion of the resilient member 90 including the first protrusion 91 (the free end portion of the main body 93) moves vertically (refer to FIG. 8).

<Raised Portion 70 and Circuit Board 64>

As illustrated in FIGS. 4, 6 and 7C, the housing 31 also includes the raised portion 70 provided on the top wall 39. The raised portion 70 protrudes upward from the top surface 39A of the top wall 39. The raised portion 70 is positioned frontward relative to the protruding part 43 and rearward relative to the projection 67. The raised portion 70 is positioned rearward of the sealing member 76. The raised portion 70 of the present embodiment has a rear surface 70A. An upper end portion of the rear surface 70A is a sloped surface 70B that slopes downward toward the rear.

The raised portion 70 supports the circuit board 64 from below. In other words, the circuit board 64 is supported on an upper surface 70C of the raised portion 70. The circuit board 64 is disposed vertically above the rear surface 91A of the first protrusion 91 of the resilient member 90. Specifically, when viewed in the vertical direction, the rear surface 91A and the circuit board 64 are overlapped with each other. In other words, the rear surface 91A and the circuit board 64 are aligned with each other in the vertical direction.

The circuit board 64 includes a substrate 63 and four electrodes 65. The substrate 63 has an upper surface 63A. The upper surface 63A of the substrate 63 supported by the upper surface 70C of the raised portion 70 faces upward.

The substrate 63 is a rigid substrate formed of glass epoxy or the like. The electrodes 65 are formed on the upper surface 63A of the substrate 63. A memory (not shown) is also mounted on the substrate 63.

Note that the number of electrodes 65 is determined based on the number of the contacts 132 in the cartridge-attachment portion 110 (see FIG. 2) and is not limited to four. Alternatively, the substrate 63 may be a flexible substrate, instead of a right substrate.

The substrate 63 is bonded to the upper surface 70C of the raised portion 70 with a photopolymer. In other words, the substrate 63 is supported by the raised portion 70 such that the substrate 63 is immovable relative to the housing 31. Here, the circuit board 64 (substrate 63) may be bonded to the upper surface 70C with an adhesive other than a photopolymer, or may be fixed to the upper surface 70C by means other than adhesives, such as thermal caulking.

The memory (not shown) stores information related to the ink cartridge 30 that can be read by the controller 1 of the printer 10. The information relating to the ink cartridge 30 may be data specifying a lot number, a manufactured date, an ink color, and the like. Incidentally, the memory (not shown) may also store information relating to data indicative of an amount of ink stored in the ink cartridge 30, such as an amount of consumed ink. The memory may be a semiconductor memory, such as a non-volatile memory (FRAM®, for example), or a volatile memory (SRAM, for example).

Incidentally, a battery may also be mounted on the substrate 63. The battery may function to supply power to the memory and be electrically connected to the memory (not shown). The battery may be a button-shaped battery (a button cell), for example. In a case where the memory includes SRAM, the information can be retained in the memory by the power supplied from the battery, without power supply from the printer 10.

Alternatively, in place of the battery, an electronic component other than the battery may be mounted on the substrate 63 for supplying power to the memory. For example, a capacitor in a charged state can be employed as another example of the electronic component. The capacitor may be charged by being inserted in a main body of the printer 10, or by receiving power from an external power source.

Each of the four electrodes 65 formed on the substrate 63 corresponds to one of the four contacts 132 in the cartridge-attachment portion 110 (see FIG. 3B). As shown in FIGS. 4 and 7C, each electrode 65 extends in the front-rear direction. The electrodes 65 are arranged parallel to one another and are spaced apart from one another in the left-right direction on the upper surface 63A of the substrate 63. Each electrode 65 is electrically connected to the memory (not shown).

<Operations for Attaching the Ink Cartridge 30 to the Cartridge-Attachment Portion 110>

Next, operations for mounting the ink cartridge 30 in the cartridge holder 101 of the cartridge-attachment portion 110 will be described.

FIG. 6 shows the ink cartridge 30 prior to being mounted in the cartridge-attachment portion 110. At this time, the seal 141 seals the air communication port 140 so that the storage chamber 32 is not in communication with the atmosphere. Prior to mounting the ink cartridge 30 in the cartridge-attachment portion 110, the user peels off the seal 141, thereby opening the storage chamber 32 to the atmosphere. Also, prior to the ink cartridge 30 being mounted in the cartridge-attachment portion 110, the valve 79 is in contact with the sealing member 76. Consequently, ink stored in the storage chamber 32 is prevented from flowing out of the ink cartridge 30 through the through-hole 76A.

In a state where the ink cartridge 30 is not attached to the cartridge-attachment portion 110 as shown in FIG. 2, nothing is positioned between the light-emitting part and light-receiving part of the optical sensor 113. Hence, light is allowed to travel from the light-emitting part to the light-receiving part. At this time, the optical sensor 113 outputs a high level detection signal to the controller 1 (see FIG. 1). Further, prior to attachment of the ink cartridge 30 to the cartridge-attachment portion 110, the valve 115 closes the opening 102B, and the rear end of the valve 115 protrudes rearward from the opening 102B.

Figure 8:
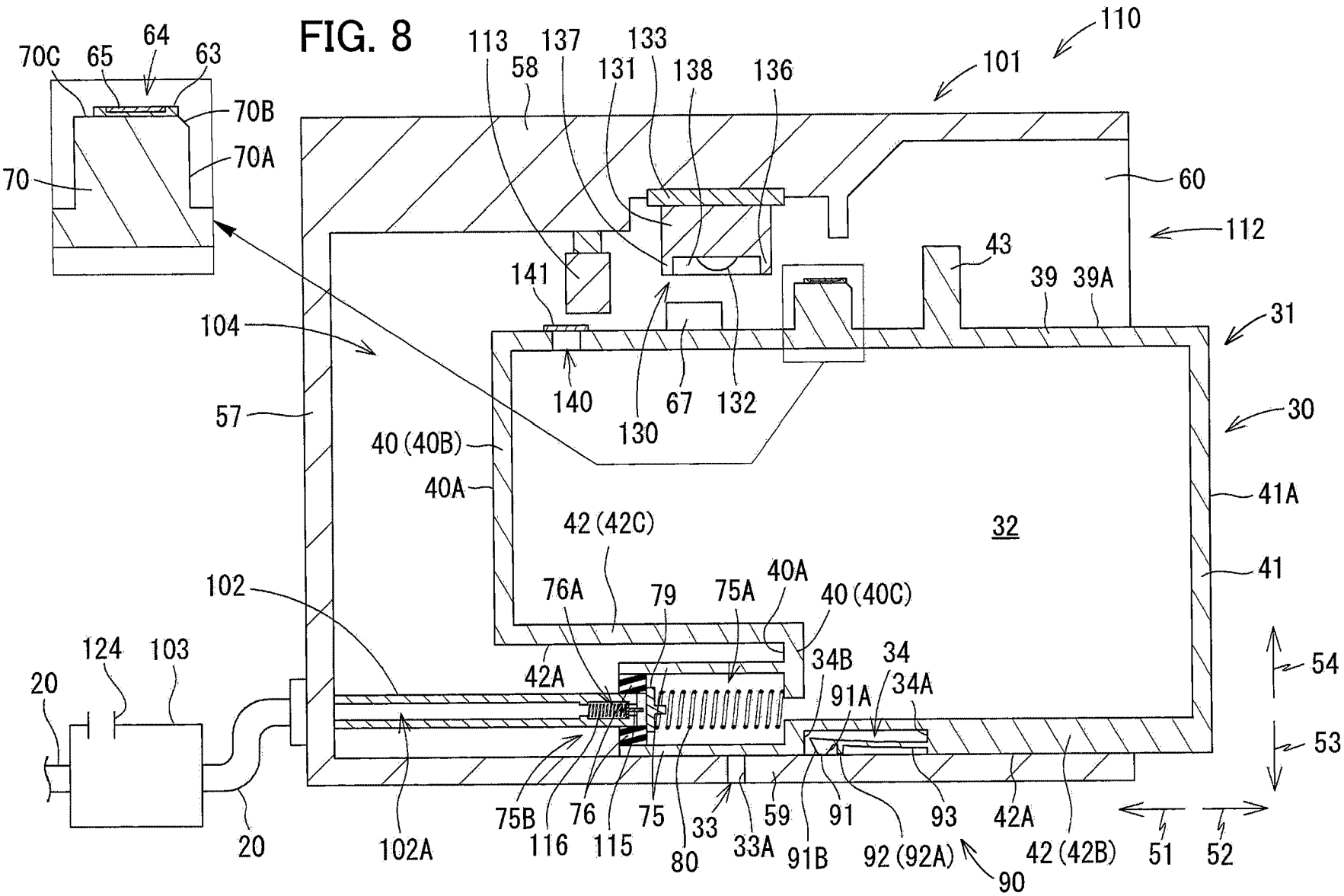
FIG. 8 is a vertical cross-sectional view illustrating a state where the ink cartridge according to the first embodiment is inserted into the cartridge-attachment section.

In order to attach the ink cartridge 30 to the cartridge-attachment portion 110, the user inserts the ink cartridge 30 forward into the cartridge holder 101 through the opening 112 of the cartridge-attachment portion 110 (see FIG. 8). In the present embodiment, the ink cartridge 30 is inserted into the cartridge holder 101 in the upright posture. However, the ink cartridge 30 may instead be inserted into the cartridge holder 101 in an inclined posture inclined relative to the horizontal direction.

As the ink cartridge 30 is inserted forward into the cartridge holder 101 through the opening 112, the front surface 91B of the first protrusion 91 of the resilient member 90 is brought into abutment with the bottom wall 59 of the cartridge holder 101 from rearward. As the ink cartridge 30 is inserted further frontward into the cartridge holder 101 from this state, the front surface 91B is guided frontward relative to the bottom wall 59 due to a reaction force applied from the bottom wall 59 to the front surface 91B. As a result, the resilient member 90 is resiliently deformed such that the free end portion (free end portion) thereof moves upward. The deformed resilient member 90 has a curved shape that is convex downward in a side view, as illustrated in FIG. 8.

Figure 9:
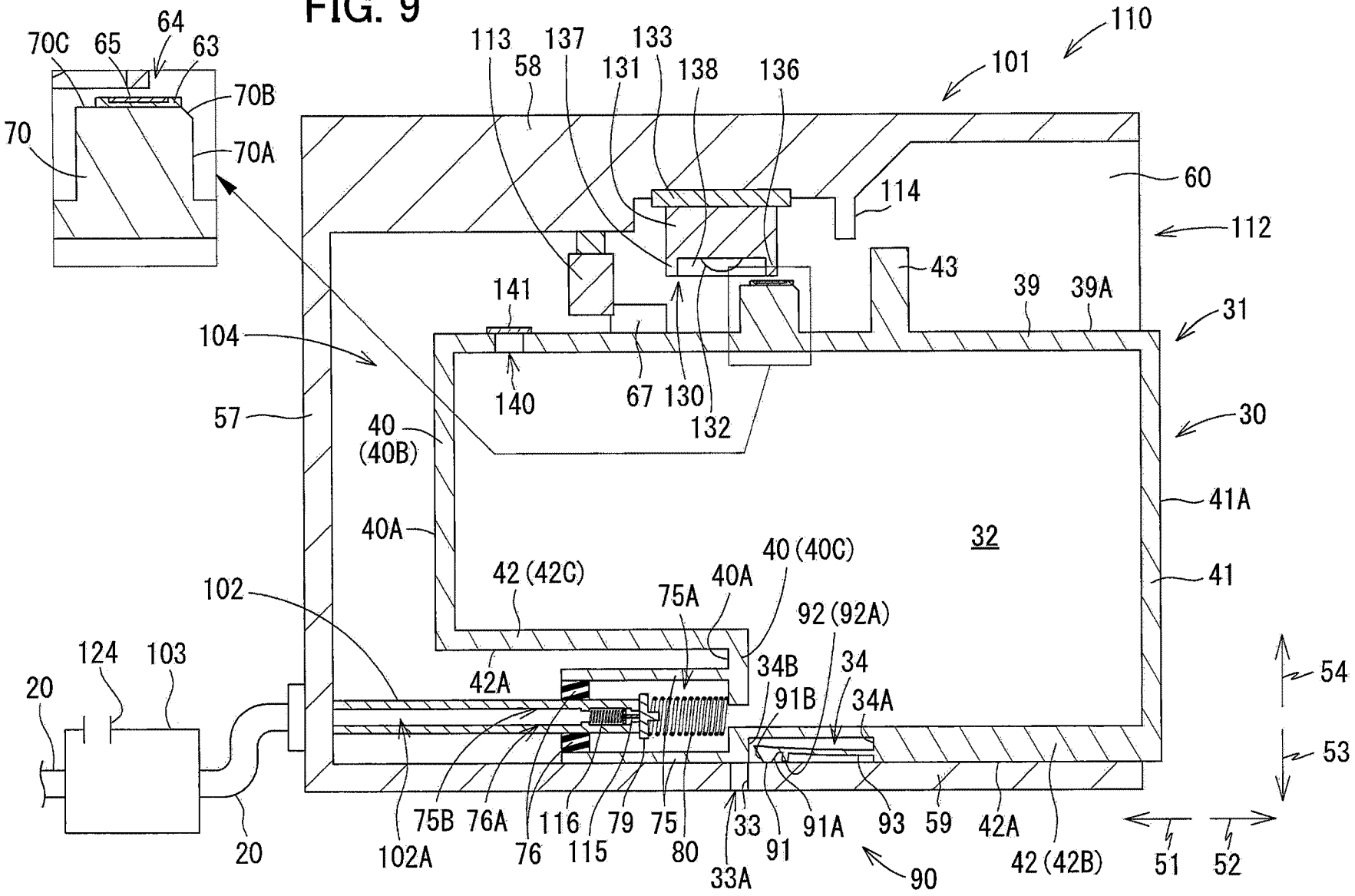
FIG. 9 is a vertical cross-sectional view illustrating a state where the ink cartridge according to the first embodiment is further inserted into the cartridge-attachment section from the state of FIG. 8.

As the ink cartridge 30 is inserted forward into the cartridge holder 101 as shown in FIG. 9, the tube 102 of the cartridge-attachment portion 110 penetrates through the through-hole 76A of the sealing member 76 (opening 75B) to be inserted into the passage 75A of the cylinder 75. At this time, the outer circumferential surface of the tube 102 closely contacts an inner circumferential surface of the sealing member 76 (the surface defining the through-hole 76A). This configuration not only forms a liquid-tight seal between the cylinder 75 and tube 102 that prevents ink from leaking into the cartridge holder 101, but also fixes the position of the cylinder 75 relative to the cartridge holder 101.

The tube 102 inserted in the passage 75A also contacts and pushes the valve 79 rearward. Through this action, the valve 79 is separated from the sealing member 76 against a forward urging force of the coil spring 80.

Further, while the distal end of the tube 102 contacts the valve 79, the valve 79 contacts the valve 115 from a rear side thereof and pushes the valve 115 forward. Consequently, the valve 115 moves forward against the urging force of the coil spring 116. Through this action, the interior space 102A of the tube 102 is made in communication with the exterior of the tube 102 through the opening 102B.

As a result, the ink stored in the storage chamber 32 can flow into the tank 103 and recording head 21 via the interior space 102A of the tube 102. At this time (in the state shown in FIG. 9), the circuit board 64 is not yet in contact with the cartridge-attachment portion 110.

In the state of FIG. 9, the rearward urging force of the coil spring 80 and coil spring 116 is applied to the ink cartridge 30. However, the ink cartridge 30 does not move rearward, since the user holds the ink cartridge 30.

During the forward insertion of the ink cartridge 30 into the cartridge holder 101 from the state of FIG. 8 to the state of FIG. 9, the circuit board 64 passes below the rear wall 136 of the connector 130, moves forward under the rear wall 136 (see FIG. 9), and reaches a position beneath the contacts 132. At this time, a gap exists between the electrodes 65 on the circuit board 64 and the contacts 132 in the vertical direction. In other words, the electrodes 65 are separated from the contacts 132. Further, the protruding part 43 comes to a position below the protruding part 114, but a gap still exists between the protruding part 114 and the protruding part 43. In other words, the protruding part 114 is separated from the protruding part 43.

Substantially at the same time as the circuit board 64 arrives at a position vertically below the contacts 132 and the protruding part 43 arrives at a position vertically below the protruding part 114, the first protrusion 91 of the resilient member 90 comes to a position vertically above the depressed portion 33 of the bottom wall 59 of the cartridge holder 101. That is, the first protrusion 91 is separated from the bottom wall 59. Since the first protrusion 91 is thus no longer applied with the reaction force from the bottom wall 59, the first protrusion 91 moves downward by resiliency of the resilient member 90 (main body 93), and engages the depressed portion 33 (see FIG. 10).

At this time, the bottom surface 92A of the second protrusion 92 of the resilient member 90 makes contact with the bottom wall 59 from below. In a state where the bottom surface 92A of the second protrusion 92 is in contact with the bottom wall 59, the resilient member 90 is still curved, i.e., the resiliency of the resilient member 90 is not completely restored yet. In other words, the bottom surface 92A of the second protrusion 92 is in abutment with the bottom wall 59 to restrict the resilient member 90 from restoring its original shape by resiliency thereof. As a result, the resilient member 90 is applied with an upward reaction force from the bottom wall 59 via the second protrusion 92. The ink cartridge 30 is lifted upward by the upward reaction force applied to the resilient member 90.

As a result of the upward movement of the ink cartridge 30, the electrodes 65 of the circuit board 64 contact the respective contacts 132 from below, thereby resiliently deforming the contacts 132 upward (see FIG. 10). That is, the electrodes 65 are electrically connected to the contacts 132 while resiliently deforming the contacts 132 upward. With the four electrodes 65 contacting the corresponding contacts 132 so that electricity can be conducted therebetween, a voltage Vc is applied to the electrodes 65, the electrodes 65 are grounded, and power is supplied to the electrodes 65. Through this electrical connection between the contacts 132 and electrodes 65, the memory (not shown) mounted on the circuit board 64 is also electrically connected to the controller 1 (see FIG. 1). Consequently, the controller 1 can access the memory (not shown), enabling data stored in the memory to be inputted into the controller 1 (see FIG. 1).

Further, the protruding part 43 (a top surface thereof) comes into contact with the protruding part 114 from below. This contact of the protruding part 43 with the protruding part 114 serves to fix the vertical position of the ink cartridge 30 in the cartridge holder 101 (see FIG. 10).

In the meantime, when the circuit board 64 comes to a location vertically below the contacts 132 and the protruding part 43 comes to a location vertically below the protruding part 114, the rear surface 91A of the first protrusion 91 faces rearward and opposes a side surface 33A of the depressed portion 33. The side surface 33A is a surface defining part of the depressed portion 33 and facing frontward. When the user releases his hand from the ink cartridge 30 at this timing, the ink cartridge 30 is moved rearward by the urging forces of the coil springs 80 and 116. The rear surface 91A of the first protrusion 91 thus comes into contact with the side surface 33A from frontward, preventing the ink cartridge 30 from moving further rearward. That is, the first protrusion 91 engages the depressed portion 33 at the rear surface 91A to provide positioning to the ink cartridge 30 in the front-rear direction, as shown in FIG. 10. The point of contact between the rear surface 91A and the side surface 33A will be referred to as a contact point 44 (see FIG. 10), hereinafter.

In the state shown in FIG. 10, the ink cartridge 30 is in the attached state to the cartridge-attachment portion 110. In the attached state, the cartridge holder 101 holds the ink cartridge 30 in the interior space 104.

Hereinafter, the attached state of the ink cartridge 30 in the cartridge-attachment portion 110 (the ink cartridge 30 in its operational posture) will be described with reference to FIG. 10.

In the attached state depicted in FIG. 10, the tube 102 of the cartridge-attachment portion 110 is inserted inside the passage 75A of the cylinder 75. Hence, the ink in the storage chamber 32 can flow into the interior space 102A of the tube 102.

Further, the projection 67 is positioned between the light-emitting part and light-receiving part of the optical sensor 113. Consequently, the projection 67 blocks the progression of light from the light-emitting part to the light-receiving part. That is, in the attached state of the ink cartridge 30, the projection 67 is positioned in the optical path of the light irradiated from the light-emitting part. Put different way, the optical sensor 113 is arranged such that the light-blocking surface of the projection 67 is located on the optical path of the light irradiated from the light-emitting part when the ink cartridge 30 is in the attached state. At this time, the optical sensor 113 outputs a low level detection signal to the controller 1 (see FIG. 1).

Also, in the attached state shown in FIG. 10, the front wall 137 of the connector 130 is positioned frontward of the circuit board 64, while the rear wall 136 of the connector 130 is positioned rearward of the circuit board 64. That is, the electrodes 65 are interposed between the front wall 137 and rear wall 136 in the front-rear direction when the ink cartridge 30 is in the attached state. In other words, the rear wall 136 and front wall 137 are juxtaposed in the front-rear direction with the electrodes 65 interposed therebetween.

Further, as shown in FIG. 3B, the right wall 138 of the connector 130 is positioned rightward of the circuit board 64, whereas the left wall 139 of the connector 130 is positioned leftward of the circuit board 64 in the attached state of the ink cartridge 30. Further, bottom edges of the right wall 138 and left wall 139 are positioned lower than the electrodes 65. With this configuration, the right wall 138 and left wall 139 interpose the electrodes 65 therebetween in the left-right direction when the ink cartridge 30 is in the attached state. That is, the right wall 138 and left wall 139 are juxtaposed in the left-right direction with the electrodes 65 interposed therebetween.

Further, in the attached state of the ink cartridge 30 shown in FIG. 10, at least a portion of the circuit board 64 is positioned at a prescribed location 45 in the front-rear direction defined on the upper surface of the housing 31 (in the present embodiment, on the upper surface 70C of the raised portion 70). Here, the prescribed location 45 is a point of tangency between the upper surface 70C in the attached state and an imaginary plane 46 representing a locus of pivoting of the housing 31 about the contact point 44 where the rear surface 91A abuts on the side surface 33A. That is, a portion of the circuit board 64 is in alignment with the prescribed location 45 in the front-rear direction (insertion direction of the ink cartridge 30). In the present embodiment, the electrodes 65 are overlapped with the prescribed location 45 (i.e., the contact point 44) when viewed vertically. In other words, a portion of the circuit board 64 is positioned vertically above the contact point 44.

To extract the ink cartridge 30 from the cartridge holder 101 of the cartridge-attachment portion 110, the user holds the ink cartridge 30 to move the ink cartridge 30 rearward. Through this operation, a reaction force is applied from the side surface 33A of the depressed portion 33 to the rear surface 91A of the first protrusion 91 of the resilient member 90. Due to the reaction force, the resilient member 90 is resiliently deformed, so that the first protrusion 91 rides onto the bottom wall 59. Accordingly, the first protrusion 91 no longer prevents rearward movement of the ink cartridge 30. In the meantime, since the second protrusion 92 of the resilient member 90 no longer receives the upward reaction force from the bottom wall 59, the ink cartridge 30 is moved downward. The downward movement of the ink cartridge 30 separates the circuit board 64 and protruding part 43 from the contacts 132 and protruding part 114, respectively. As the ink cartridge 30 is pulled out further rearward by the user, the ink cartridge 30 can be removed from the cartridge-attachment portion 110.

<Detecting Attachment of the Ink Cartridge 30 to the Cartridge-Attachment Portion 110>

Next, operations for detecting attachment of an ink cartridge 30 to the cartridge-attachment portion 110 will be described with reference to flowcharts shown in FIGS. 11 and 12.

Figure 11:
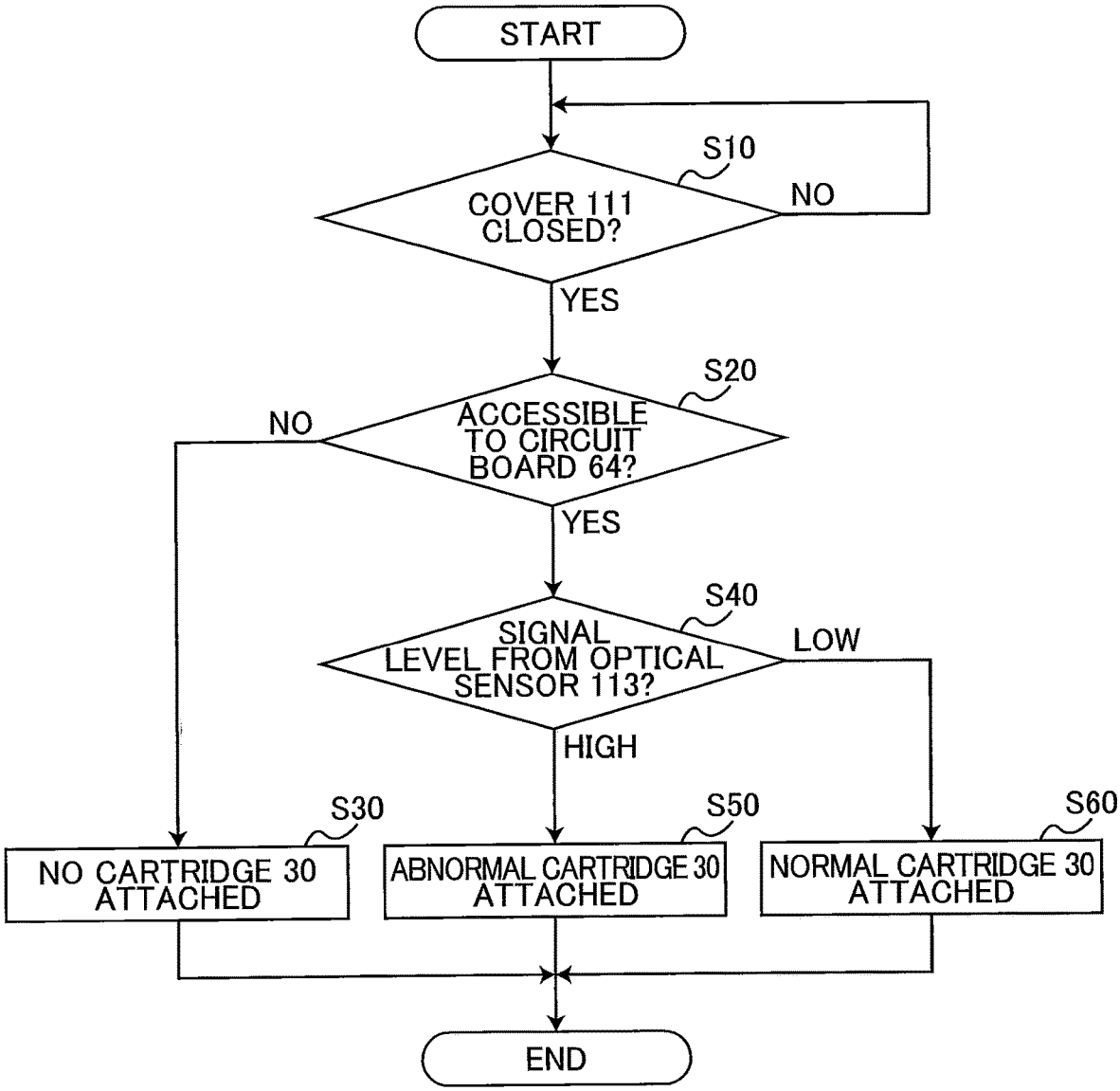
FIG. 11 is a flowchart illustrating steps to determine whether the ink cartridge according to the first embodiment is attached to the cartridge-attachment section.
Figure 12:
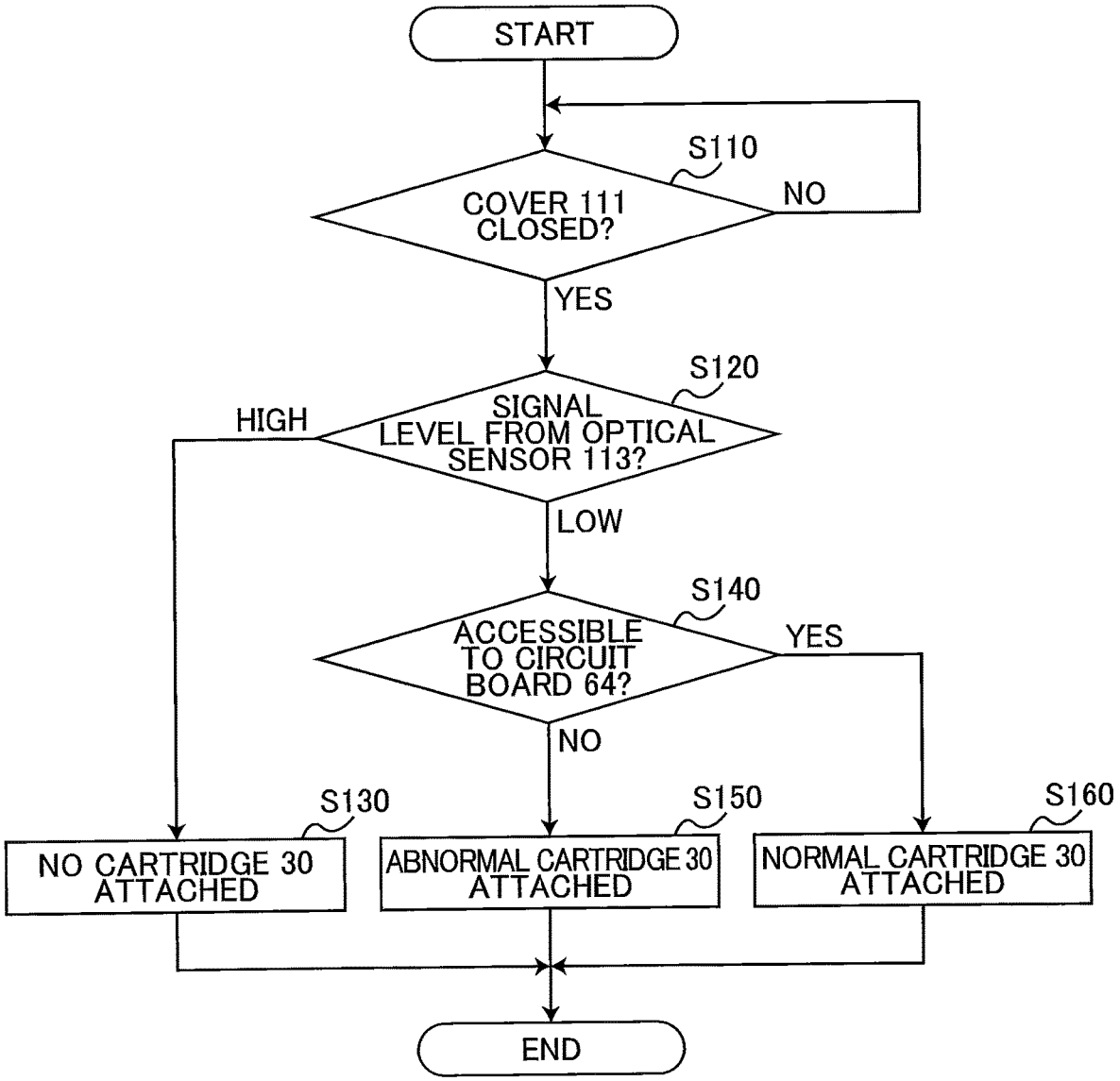
FIG. 12 is a flowchart illustrating another way of determining whether the ink cartridge according to the first embodiment is attached to the cartridge-attachment section.

The flowcharts of FIGS. 11 and 12 are configured to be initiated when the cover 111 is opened by the user. That is, the controller 1 is configured to launch the flowchart of FIG. 11 or the flowchart of FIG. 12 in response to receiving a high level signal outputted from the cover sensor 118.

As shown in FIG. 11, in S10 the controller 1 (see FIG. 1) determines whether the cover 111 is in the closed position. Specifically, the controller 1 determines that the cover 111 is in the closed position when the signal outputted from the cover sensor 118 changes to a low level signal.

In a case where the cover 111 is not in the closed position (S10: NO), the controller 1 repeats the determination in S10 until the cover 111 is determined to be closed, i.e., until the signal outputted from the cover sensor 118 changes from high level to low level.

When the cover 111 is determined to be in the closed position (S10: YES), in S20 the controller 1 determines whether the memory (not shown) on the circuit board 64 of the ink cartridge 30 is accessible, i.e., whether the controller 1 can read from or write to the memory. The controller 1 is able to access the memory on the circuit board 64 when the contacts 132 are in contact with and electrically connected to the electrodes 65 on the circuit board 64. When the contacts 132 are not in contact with the electrodes 65 on the circuit board 64, the controller 1 cannot access the memory.

If the controller 1 cannot access the memory of the circuit board 64 (S20: NO), in S30 the controller 1 determines that no ink cartridge 30 is mounted in the cartridge-attachment portion 110. In this case, the controller 1 notifies the user that no ink cartridge 30 is mounted by displaying a message on a display panel (not shown) provided on a housing of the printer 10 and/or emitting a beep or other sound from a speaker (not shown).

When the controller 1 can access the circuit board 64 (S20: YES), in S40 the controller 1 determines whether the signal outputted from the optical sensor 113 is high level or low level. When the projection 67 is positioned between the light-emitting part and light-receiving part of the optical sensor 113, the optical sensor 113 outputs a low level signal to the controller 1. When the projection 67 is not positioned between the light-emitting part and light-receiving part of the optical sensor 113, the optical sensor 113 outputs a high level signal to the controller 1.

When the signal outputted from the optical sensor 113 to the controller 1 is high level (S40: HIGH), the controller 1 determines in S50 that an abnormal ink cartridge 30 is attached to the cartridge-attachment portion 110. In this case, the controller 1 notifies the user that an abnormal ink cartridge 30 is mounted by displaying a message on the display panel (not shown) provided on the housing of the printer 10 and/or playing a beep or other sound from the speaker (not shown).

On the other hand, if the signal outputted by the optical sensor 113 is low level (S40: LOW), in S60 the controller 1 determines that a normal ink cartridge 30 is attached to the cartridge-attachment portion 110.

In the flowchart of FIG. 11, the controller 1 determines whether an ink cartridge 30 is mounted in the cartridge-attachment portion 110 based on whether the circuit board 64 is accessible, and determines whether the ink cartridge 30 mounted in the cartridge-attachment portion 110 is normal based on the level of the signal outputted from the optical sensor 113.

Alternatively, the controller 1 may be configured to determine whether an ink cartridge 30 is mounted in the cartridge-attachment portion 110 based on the level of the signal outputted from the optical sensor 113 and to determine whether the ink cartridge 30 mounted in the cartridge-attachment portion 110 is normal based on whether the circuit board 64 is accessible. Steps in this variation will be described next with reference to the flowchart in FIG. 12.

Referring to FIG. 12, the controller 1 first determines in S110 whether the cover 111 is in the closed position, as in S10 of the flowchart of FIG. 11. In a case where the 111 is determined to be in the open position (S110: NO), the controller 1 repeats the determination in S110 until the cover 111 is determined to be in the closed position, i.e., until the signal outputted from the cover sensor 118 changes from high level to low level.

When the controller 1 determines in S110 that the cover 111 is in the closed position (S110: YES), in S120 the controller 1 determines whether the signal outputted from the optical sensor 113 to the controller 1 is high level or low level.

If the signal outputted by the optical sensor 113 is high level (S120: HIGH), in S130 the controller 1 determines that no ink cartridge 30 is mounted in the cartridge-attachment portion 110. In this case, as in S30 of FIG. 11, the controller 1 notifies the user that no ink cartridge 30 is mounted.

However, if the signal outputted by the optical sensor 113 is low level (S120: LOW), in S140 the controller 1 determines whether the circuit board 64 of the ink cartridge 30 is accessible.

If the controller 1 cannot access the circuit board 64 (S140: NO), in S150 the controller 1 determines that an abnormal ink cartridge 30 is mounted in the cartridge-attachment portion 110. In this case, as in S50 of FIG. 11, the controller 1 notifies the user that an abnormal ink cartridge 30 is mounted.

On the other hand, if the controller 1 can access the circuit board 64 (S140: YES), in S160 the controller 1 determines that a normal ink cartridge 30 is mounted in the cartridge-attachment portion 110.

<Operational and Technical Advantages of First Embodiment>

According to the described embodiment, the passage 75A is positioned closer to the rear surface 91A than to the circuit board 64 in the vertical direction. With this structure, ink that may accidentally leak through the passage 75A is less likely to adhere to the circuit board 64. Further, since the circuit board 64 and rear surface 91A are positioned rearward of the sealing member 76, ink leaked through the passage 75A is less likely to adhere to the circuit board 64 and rear surface 91A.

In the depicted first embodiment, the passage 75A is positioned closer to the bottom surface 42A (i.e., the rear surface 91A of the first protrusion 91) than to the top surface 39A of the ink cartridge 30 in the vertical direction. In other words, in the attached posture of the ink cartridge 30, a distance (shortest distance) between an axis of the cylinder 75 and the first protrusion 91 in the vertical direction is shorter than a distance (shortest distance) between the axis of the cylinder 75 and the protruding part 43 in the vertical direction. With this structure, compared to a structure where the first protrusion 91 is disposed on the top surface 39A, moment can become smaller, and, hence, load applied to the cartridge-attachment portion 110 from the rear surface 91A of the first protrusion 91 can be made smaller. Creep deformation is therefore less likely to occur in the cartridge-attachment portion 110, thereby enhancing positioning accuracy of the circuit board 64.

Further, the resilient member 90 is resiliently deformable to move the rear surface 91A of the first protrusion 91 downward, thereby allowing the first protrusion 91 (the rear surface 91A) to engage with the depressed portion 33 (side surface 33A). In the attached state of the ink cartridge 30, as the bottom surface 92A of the second protrusion 92 abuts on the bottom wall 59 of the cartridge-attachment portion 110 to restrict resilient restoration of the resilient member 90, the resilient member 90 receives the reaction force from the bottom wall 59 by which force the ink cartridge 30 is moved upward. The electrodes 65 of the circuit board 64 can be brought into contact with the contacts 132 of the cartridge-attachment portion 110 accordingly, as a result of the upward movement of the ink cartridge 30.

With the structure of the first embodiment, the circuit board 64 is supported by the housing 31 so as to be immovable relative to the housing 31. Hence, the circuit board 64 can be stably positioned relative to the housing 31.

Further, the sealing member 76 is elastically deformable. Accordingly, the ink cartridge 30 inserted in the cartridge-attachment portion 110 is allowed to pivot about the contact point 44 due to the elasticity of the sealing member 76. The circuit board 64 is positioned at the prescribed location 45 in the front-rear direction, the prescribed location 45 being coincident with a point of tangency between to the top wall 39 and the imaginary plane 46 representing the pivoting locus of the housing 31 about the contact point 44. That is, the circuit board 64 has a portion in alignment with the prescribed location 45 in the front-rear direction. With this structure, even if the housing 31 (ink cartridge 30) is pivoted about the contact point 44, the circuit board 64 is likely to move by a smaller amount in the vertical direction than otherwise. That is, the vertical position of the circuit board 64 is less likely to change even if the housing 31 is pivoted about the contact point 44. The structure of the first embodiment can provide higher positioning accuracy between the electrodes 65 of the circuit board 64 and the contacts 132.

Further, the raised portion 70 of the first embodiment has an upper-rear corner portion formed as the sloped surface 70B. With this structure, even if a component belonging to the cartridge-attachment portion 110 (the rear wall 136 of the connector 130 in the first embodiment) is positioned rearward of the raised portion 70 in the attached state of the ink cartridge 30, the component (rear wall 136) can be guided along the sloped surface 70B during detachment of the ink cartridge 30 from the cartridge-attachment portion 110. In this way, the existence of the rear wall 136 does not bother the rearward movement of the raised portion 70 during detachment of the ink cartridge 30.

Further, the rear surface 91A of the first protrusion 91 is sloped relative to the horizontal direction. In the attached state of the ink cartridge 30, the rear surface 91A is in engagement with the depressed portion 33 (a component of the cartridge-attachment portion 110 positioned rearward of the rear surface 91A). However, the depressed portion 33 (the component of the cartridge-attachment portion 110) is guided along the sloped rear surface 91A during removal of the ink cartridge 30 from the cartridge-attachment portion 110, thereby realizing disengagement of the rear surface 91A from the depressed portion 33.

Further, according to the structure of the first embodiment, the ink cartridge 30 is able to pivot about a contact point between the sealing member 76 and tube 102 in a state where the sealing member 76 is in contact with the tube 102. Hence, the circuit board 64 is allowed to move vertically in the state where the sealing member 76 and the tube 102 are connected to each other. Further, the contact between the sealing member 76 and tube 102 can prevent leakage of ink through therebetween.

The contacts 132 are interposed between the front wall 137 and rear wall 136 in the front-rear direction in the cartridge-attachment portion 110 of the first embodiment. However, in the ink cartridge 30 of the first embodiment, the circuit board 64 is movable vertically relative to the cartridge holder 101 due to the resilient deformation of the resilient member 90. With this structure, the circuit board 64 can be moved to a position where the electrodes 65 can make contact with the contacts 132 during insertion of the ink cartridge 30 into the cartridge-attachment portion 110, regardless of the existence of the front wall 137 and rear wall 136.

Second Embodiment

In the first embodiment, the circuit board 64 is immovably supported by the housing 31. However, the circuit board 64 may be movably supported by the housing 31. As an example, an ink cartridge 230 according to a second embodiment will be described with reference to FIGS. 13 through 17. In the following description, structures different from those of the first embodiment will be described, while like parts and components will be designated with the same reference numerals as those of the first embodiment in order to avoid duplicating explanation.

Figure 13:
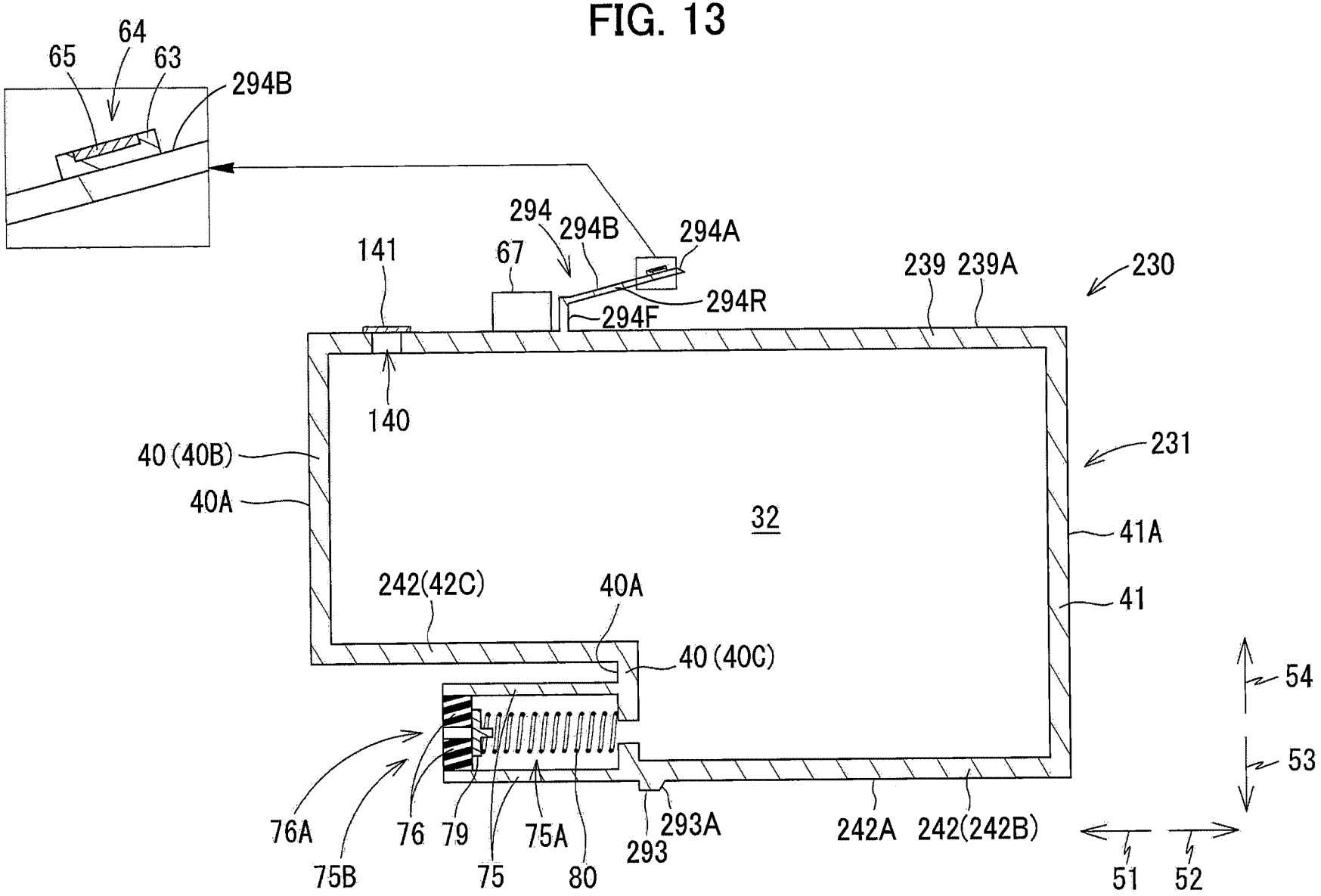
FIG. 13 is a vertical cross-sectional view of an ink cartridge according to a second embodiment of the disclosure in an upright posture thereof.
Figure 14A:
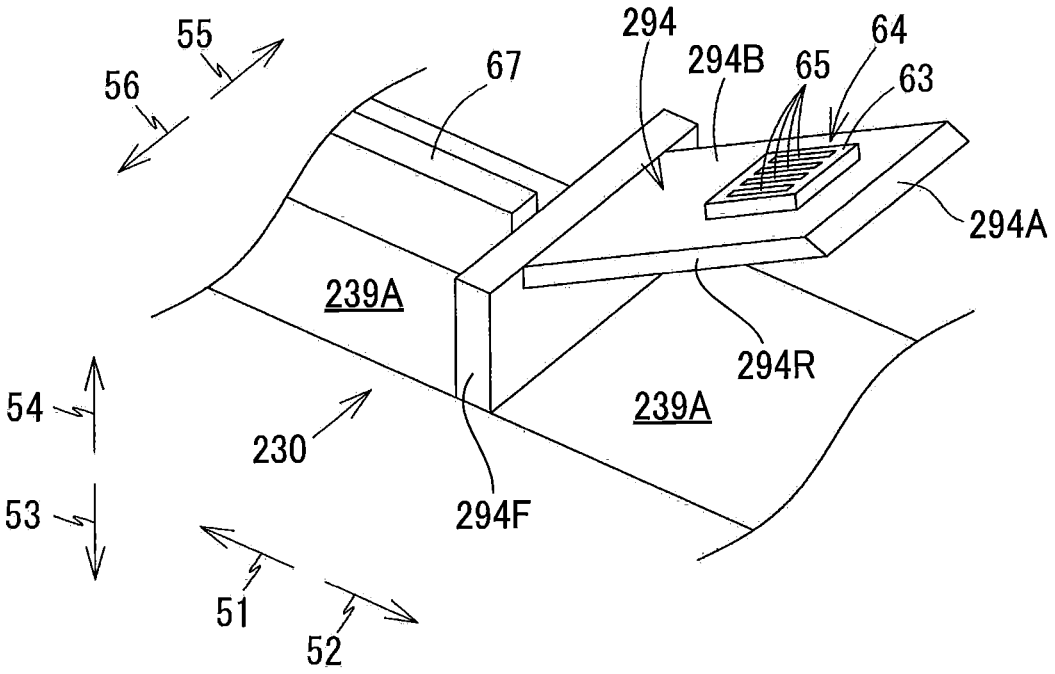
FIG. 14A is a perspective view illustrating a structure in the vicinity of a resilient member in the ink cartridge according to the second embodiment in the upright posture.
Figure 14B:
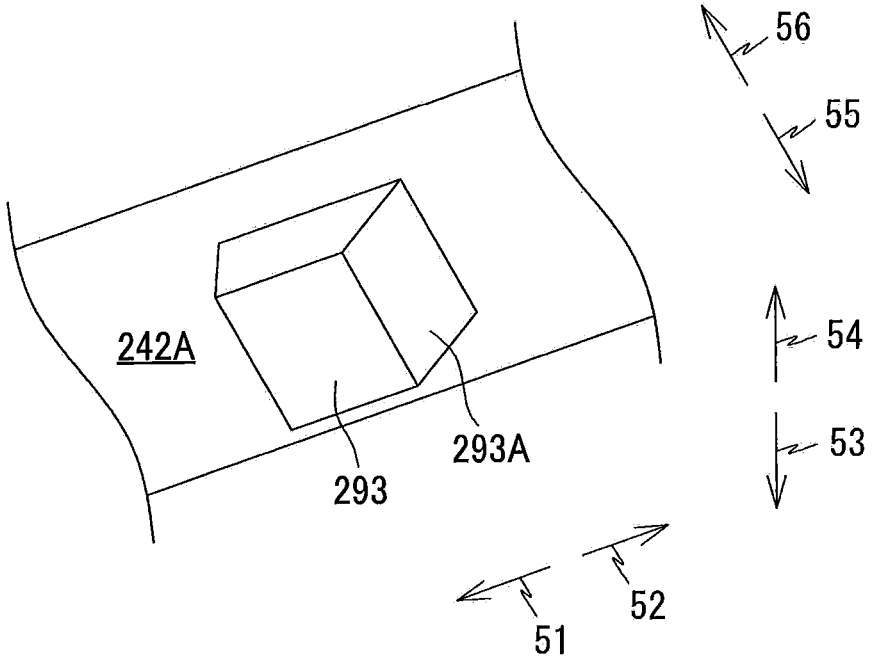
FIG. 14B is a perspective view illustrating a structure in the vicinity of a protrusion in the ink cartridge according to the second embodiment in the upright posture.

As illustrated in FIGS. 13 to 14B, the ink cartridge 230 of the second embodiment includes a housing 231, a protrusion 293 and a resilient member 294. The ink cartridge 230 does not include the protruding part 43, recess 34, resilient member 90 and raised portion 70 of the first embodiment.

Specifically, as depicted in FIGS. 13 and 14B, the protrusion 293 is provided at a bottom wall 242(242B) of the housing 231. The protrusion 293 protrudes downward from a bottom surface 242A of the bottom wall 242(242B). The protrusion 293 is integral with the bottom wall 242(242B). That is, the protrusion 293 is immovable relative to the housing 231. The protrusion 293 has a rear surface 293A that is sloped upward toward the rear.

As illustrated in FIG. 13, the resilient member 294 is disposed at a top wall 239 of the housing 231. The resilient member 294 is positioned rearward relative to the projection 67 on the top wall 239. The resilient member 294 protrudes upward from a top surface 239A of the top wall 239 and extends diagonally upward and rearward. Specifically, the resilient member 294 includes a first portion 294F protruding vertically upward from the top surface 239A and a second portion 294R extending from an upper end of the first portion 239A diagonally upward toward the rear. That is, the second portion 294R is sloped relative to the top surface 239A. The resilient member 294 has a free end portion (a rear end portion of the second portion 294R) having a rear surface 294A sloping downward toward the rear. The circuit board 64 is disposed on an upper surface 294B of the second portion 294R at a position near the rear surface 294A.

The resilient member 294 is resiliently deformable. In the present embodiment, the resilient member 294 is a leaf spring whose front-rear direction is greater than a vertical direction thereof. Upon application of an external force, the resilient member 294 is resiliently deformed so that the free end portion thereof (the rear end portion of the second portion 294R) is movable in the vertical direction (see FIG. 16). That is, the resilient member 294 supports the circuit board 64 such that the circuit board 64 is movable vertically relative to the housing 231.

Figure 15:
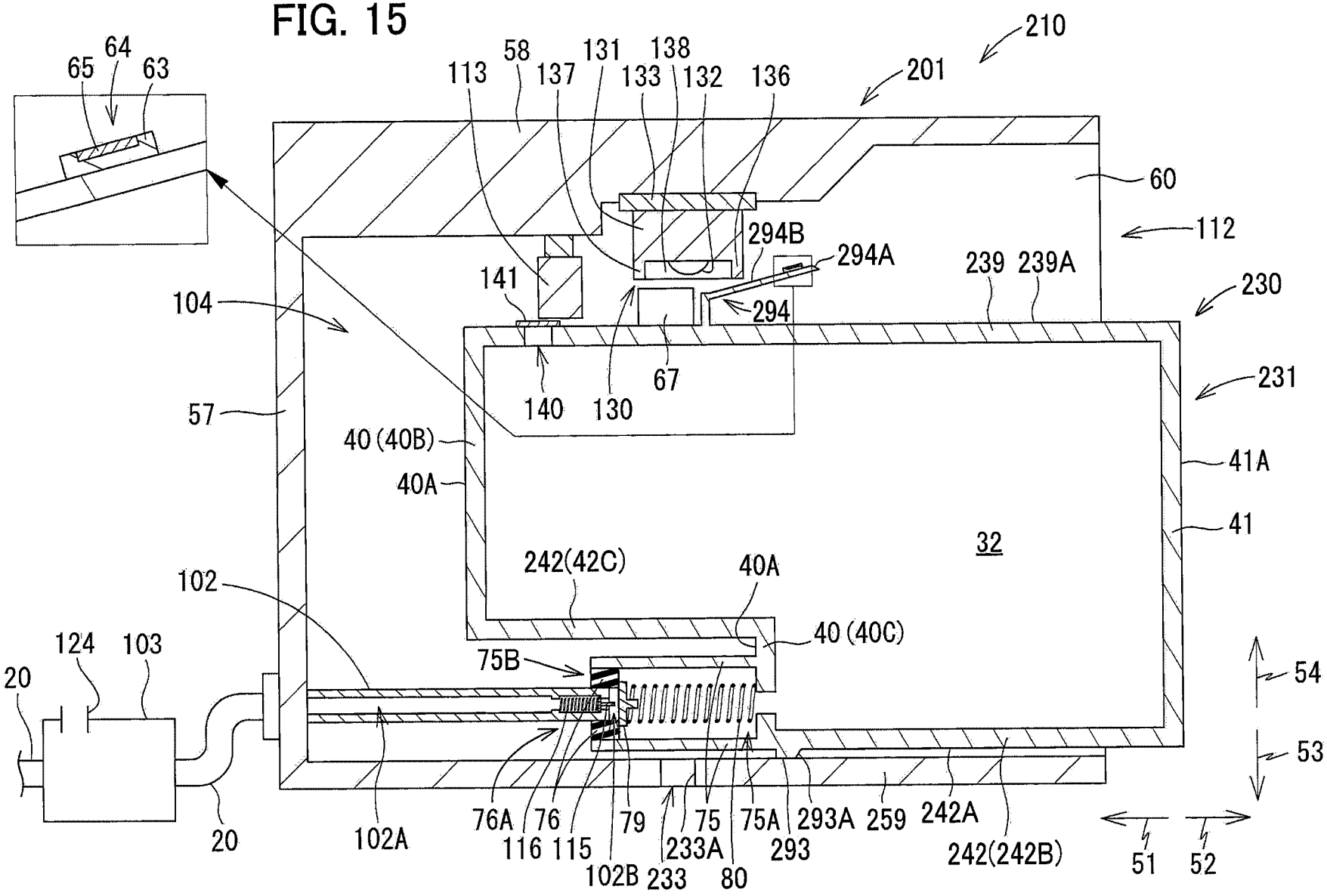
FIG. 15 is a vertical cross-sectional view illustrating a state where the ink cartridge according to the second embodiment is inserted into a cartridge-attachment section according to the second embodiment.

The ink cartridge 230 is configured to be mounted in a cartridge-attachment portion 210 according to the second embodiment. Unlike the cartridge-attachment portion 110 of the first embodiment, the cartridge-attachment portion 210 includes a cartridge holder 201 that is devoid of the protruding part 114, as illustrated in FIG. 15. The cartridge holder 201 has a bottom wall 259 formed with a depressed portion 233 to penetrate vertically therethrough.

For mounting the ink cartridge 230 into the cartridge-attachment portion 210, the ink cartridge 230 is inserted forward into the cartridge holder 201 through the opening 112, with the protrusion 293 supported by the bottom wall 259 from below.

As the ink cartridge 230 is inserted further forward, the upper surface 294B of the resilient member 294 comes into contact with the rear wall 136 of the connector 130 from a rear side thereof. As the ink cartridge 230 is inserted further forward from this state, the resilient member 294 is resiliently deformed by a reaction fore applied from the rear wall 136 to the upper surface 294B. Specifically, the resilient member 294 is resiliently deformed such that the free end portion of the resilient member 294 is moved downward. The deformed resilient member 294 is curved to be convex upward in a side view, as illustrated in FIG. 16.

As the ink cartridge 230 is inserted further forward from the state of FIG. 16, the rear wall 136 is guided relatively over the upper surface 294B of the resilient member 294 and a top surface of the circuit board 64, so that the circuit board 64 moves below the rear wall 136 and past the rear wall 136, and arrives at a position below the contacts 132. Thereafter, the free end portion (rear surface 294A) of the resilient member 294 moves past the rear wall 136, and separates from the rear wall 136. The resilient member 294 thus resiliently deform to restore its original shape. Accordingly, the circuit board 64 moves upward, thereby causing the electrodes 65 to contact the contacts 132 from below, as illustrated in FIG. 17.

Figure 16:
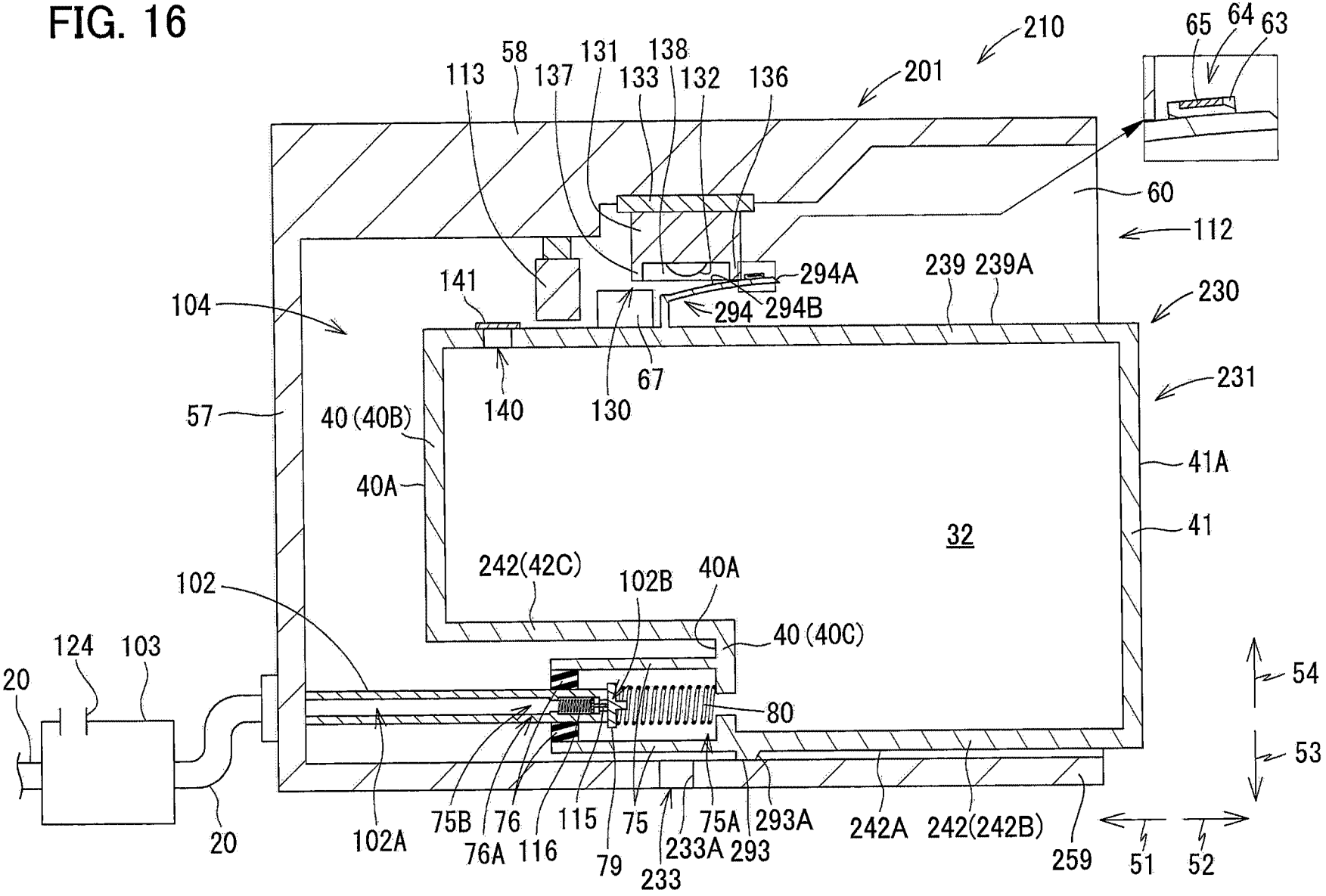
FIG. 16 is a vertical cross-sectional view illustrating a state where the ink cartridge according to the second embodiment is inserted further into the cartridge-attachment section according to the second embodiment from the state of FIG. 15.
Figure 17:
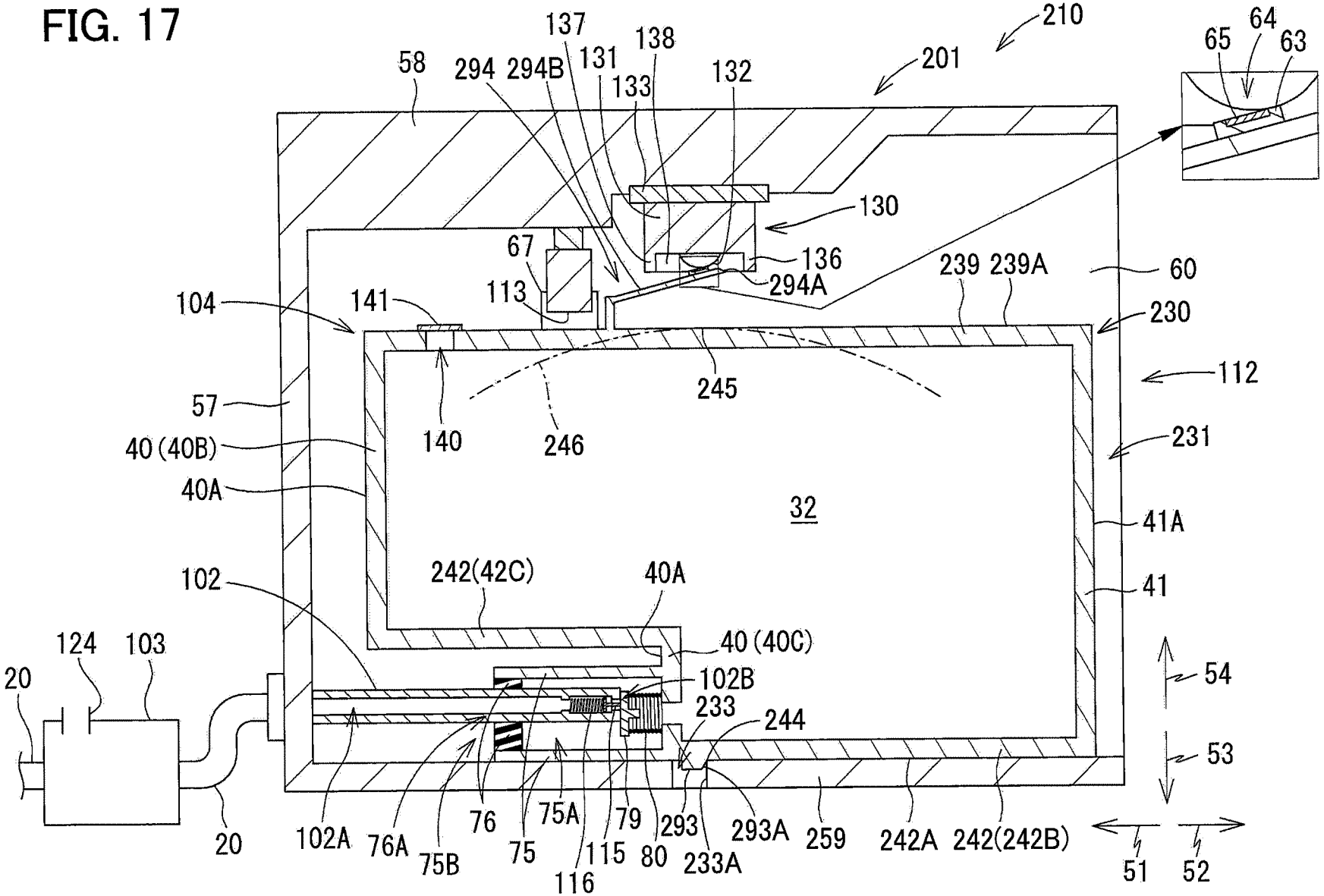
FIG. 17 is a vertical cross-sectional view illustrating a state where the ink cartridge according to the second embodiment is attached to the cartridge-attachment section according to the second embodiment.

As the ink cartridge 230 is inserted forward from the state depicted in FIG. 16, the protrusion 293 comes to a location vertically above the depressed portion 233 of the cartridge-attachment portion 210. The protrusion 293 is thus fitted in the depressed portion 233 due to the gravitational force (self-weight of the ink cartridge 230), as illustrated in FIG. 17. When the user releases his hand from the ink cartridge 230 at this time, the ink cartridge 230 is caused to move rearward by the urging forces of the coil springs 80 and 116. The rear surface 293A of the protrusion 293 is thus made in abutment with a side surface 233A of the depressed portion 233 from frontward thereof. The ink cartridge 230 is fixed in position within the cartridge holder 201 in the front-rear direction. At this time, the rear surface 293A is in engagement with the depressed portion 233 (side surface 233A), thereby restricting the ink cartridge 230 from moving further rearward. A point of contact between the rear surface 293A and the side surface 233A will be defined as a contact point 244 (see FIG. 17). In the second embodiment, the state illustrated in FIG. 17 is the attached state of the ink cartridge 230.

In the attached state of the ink cartridge 230, at least a portion of the circuit board 64 is located at a position coincident with a prescribed location 245 on the top surface of the housing 231 in the front-rear direction. In the present embodiment, the prescribed location 245 is on the top surface 239A of the top wall 239 and is a tangent point between the top surface 239A and an imaginary plane 246 representing an arcuate trajectory centered on the contact point 244 between the rear surface 293A and the side surface 233A. That is, the circuit board 64 is at the same position as the prescribed location 245 in the front-rear direction in the attached state of the ink cartridge 230.

In order to remove the ink cartridge 230 from the cartridge holder 201 of the cartridge-attachment portion 210, the user holds the ink cartridge 230 and pulls the ink cartridge 230 rearward. Accordingly, an upper edge of the side surface 233A (upper-rear edge of the depressed portion 233) is guided relatively over the rear surface 293A of the protrusion 293, and the protrusion 293 is thus moved onto the bottom wall 259. The protrusion 293 no longer prevents rearward movement of the ink cartridge 230.

As the ink cartridge 230 is pulled further rearward, the rear surface 294A of the resilient member 294 comes into contact with the rear wall 136 from frontward thereof. As the rear wall 136 is guided relatively along the rear surface 294A, the resilient member 294 is caused to resiliently deform to move the circuit board 64 downward. The circuit board 64 thus passes below the rear wall 136 and moves rearward past the rear wall 136. As the user further moves the ink cartridge 230 rearward, the ink cartridge 230 can be detached from the cartridge-attachment portion 210.

With the structure of the second embodiment, the circuit board 64 is movable vertically relative to the housing 231. Hence, even if a component of the cartridge-attachment portion 210 is positioned on a moving path of the circuit board 64, the vertical movement of the circuit board 64 enables the circuit board 64 to evade the component on the moving path during the insertion of the ink cartridge 230 into the cartridge-attachment portion 210.

First Modification to the Second Embodiment

The ink cartridge 230 of the second embodiment includes the protrusion 293 that is immovable relative to the housing 231. However, the protrusion 293 may be movable relative to the housing 231.

Figure 18A:
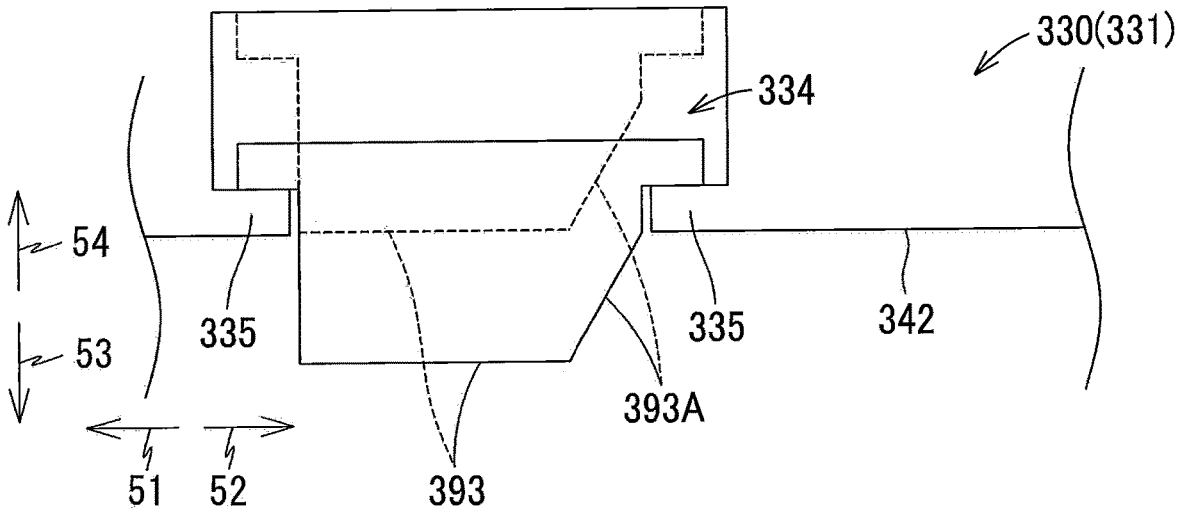
FIG. 18A is a vertical cross-sectional view schematically illustrating a structure in the vicinity of a protrusion in an ink cartridge according to a first modification to the second embodiment.

More specifically, FIG. 18A illustrates an ink cartridge 330 according to a first modification to the second embodiment. The ink cartridge 330 includes a protrusion 393 that is movably supported by a bottom wall 342 of a housing 331. The protrusion 393 is movable vertically relative to the housing 331 between an engaging position (shown in a solid line) and a retracted position (shown in a broken line). In the upright posture of the ink cartridge 330, without any external force applied thereto, the protrusion 393 is in the engaging position due to its own weight. At the engaging position, the protrusion 393 is supported by a pair of ribs 335 provided at a recess 334 formed in the bottom wall 342. The protrusion 393 has a sloped rear surface 393A.

As the ink cartridge 330 is configured to be inserted forward into the cartridge holder 201 through the opening 112, the protrusion 393 is supported from below by the bottom wall 259 of the cartridge-attachment portion 210. The protrusion 393 is at the retracted position at this time, since the protrusion 393 is applied with a reaction force from the bottom wall 259. As the ink cartridge 330 is inserted further forward and attached to the cartridge-attachment portion 210, the protrusion 393 comes to a position vertically above the depressed portion 233 of the cartridge-attachment portion 210. The protrusion 393 therefore moves to the engaging position by its own weight to bring the rear surface 393A thereof into in engagement with the depressed portion 233, thereby restricting the ink cartridge 330 from moving rearward.

For detaching the ink cartridge 330 from the cartridge holder 201, the user holds and moves the ink cartridge 330 rearward. The protrusion 393 makes contact with the side surface 233A of the depressed portion 233, moving to the retracted position from the engaging position against the gravitational force (self-weight). The ink cartridge 330 can be removed from the cartridge holder 201.

With the structure of the first modification to the second embodiment, the protrusion 393 can be moved to the retracted position during attachment of the ink cartridge 330 to the cartridge-attachment portion 210. Accordingly, the movable protrusion 393 does not interrupt insertion of the ink cartridge 330 into the cartridge-attachment portion 210, realizing smooth insertion of the ink cartridge 330 into the cartridge-attachment portion 210.

Second Modification to the Second Embodiment

In a structure where the protrusion 293 is made movable relative to the housing 231, the ink cartridge 230 may be provided with a member to move the protrusion 393 between the engaging position and the retracted position.

Figure 18B:
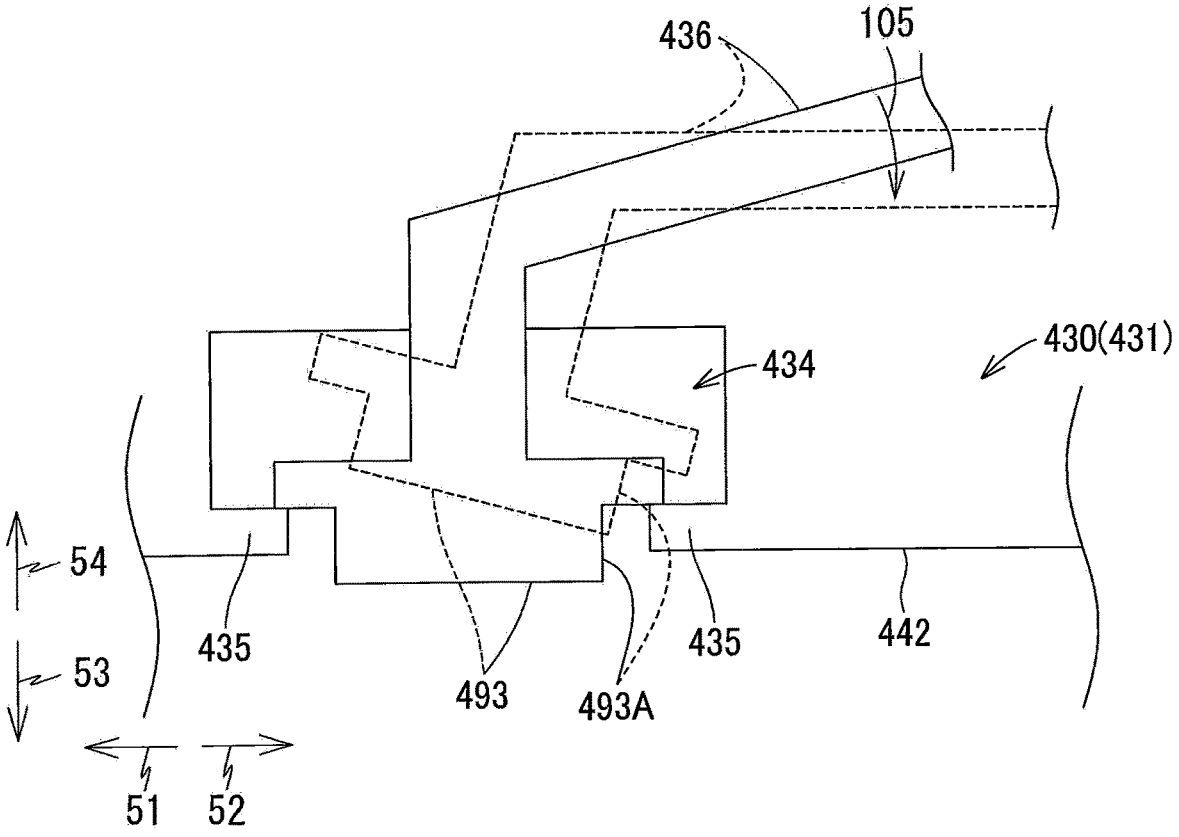
FIG. 18B is a vertical cross-sectional view schematically illustrating a structure in the vicinity of a protrusion in an ink cartridge according to a second modification to the second embodiment.

As illustrated in FIG. 18B, an ink cartridge 430 includes a protrusion 493 and an operation lever 436 connected to the protrusion 493. The protrusion 493 is movably supported by a bottom wall 442 of a housing 431. Specifically, the protrusion 493 is accommodated in a recess 434 formed in the bottom wall 442 in its retracted position, and is supported by a pair of ribs 435 provided at the recess 434 at its engaging position.

The operation lever 436 extends from the protrusion 493 rearward beyond the housing 431, while passing outside the housing 431 (extends leftward or rightward of the housing 431). In the attached state of the ink cartridge 430, the user moves (pivots) a rear end portion of the operation lever 436 downward, in a direction indicated by an arrow 105, so that the protrusion 493 is lifted upward to pivot from the engaging position to the retracted position. The ink cartridge 430 is thus made detachable from the cartridge holder 201 of the cartridge-attachment portion 210.

In the configuration of FIG. 18B, the protrusion 493 is movable between the engaging position and the retracted position by the user's operation of the operation lever 436. Hence, a rear surface 493A of the protrusion 493 need not be sloped. Unlike the protrusion 393 of the first modification, the rear surface 493A of the protrusion 493 extends vertically in the second modification.

With the structure of the second modification, the protrusion 493 can be disengaged from the cartridge-attachment portion 210 by the user's operation of the operation lever 436.

Third Embodiment

In the first embodiment, the surface of the ink cartridge 30 engageable with the cartridge-attachment portion 110 (i.e., the rear surface 91A of the first protrusion 91) is movable relative to the housing 31. In the second embodiment, the circuit board 64 is movable relative to the housing 231. Alternatively, an ink cartridge 530 according to a third embodiment includes both of the movable rear surface 91A and the circuit board 64.

Hereinafter, the ink cartridge 530 according to the third embodiment will be described with reference to FIGS. 19 through 22. In the following description, structures different from those of the above-described embodiments will be described, while like parts and components will be designated with the same reference numerals as those of the depicted embodiments in order to avoid duplicating explanation.

Figure 19:
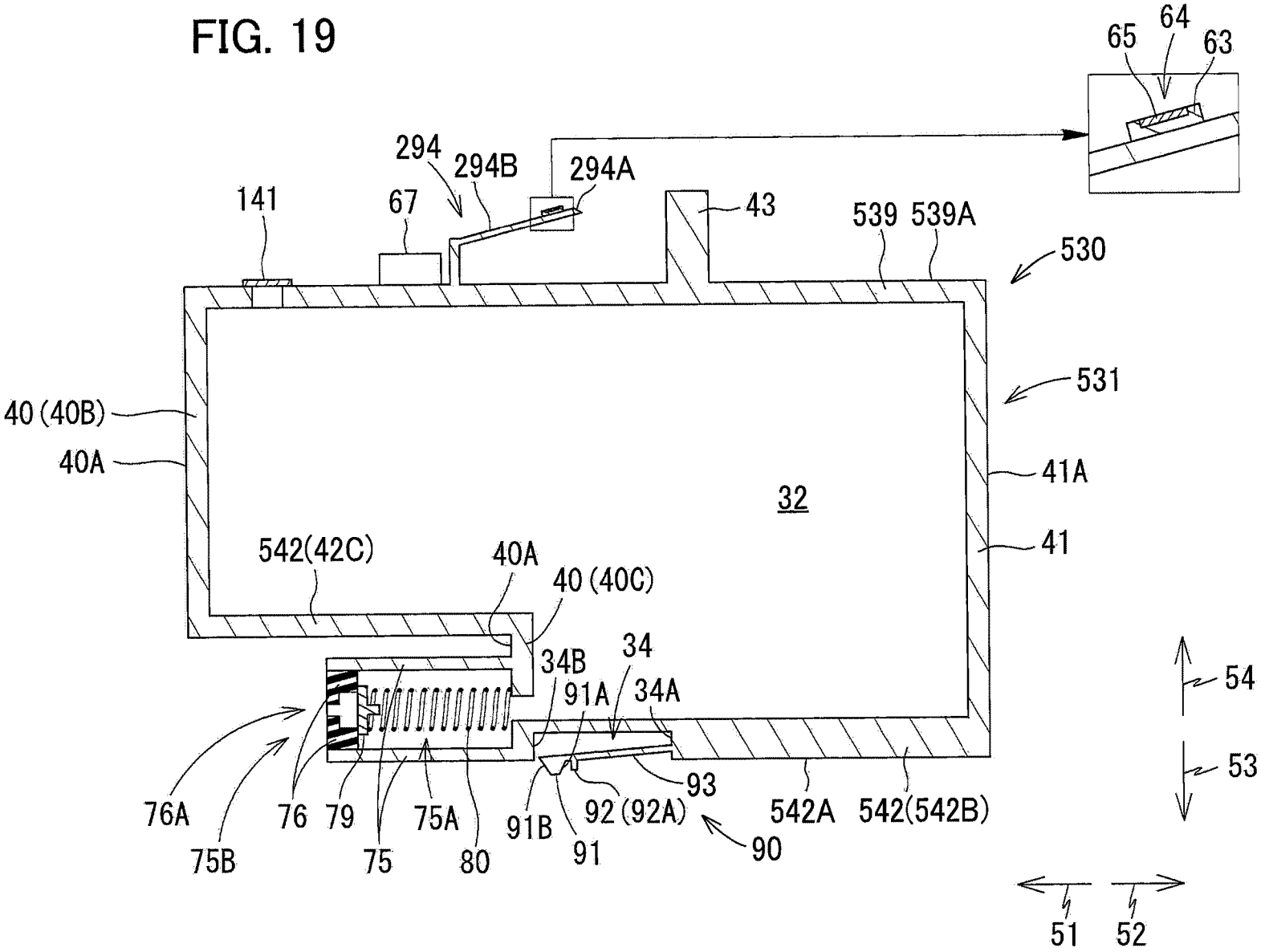
FIG. 19 is a vertical cross-sectional view of an ink cartridge according to a third embodiment of the disclosure in an upright posture thereof.

As illustrated in FIG. 19, the ink cartridge 530 of the third embodiment includes the resilient member 90 of the first embodiment that is provided at a bottom wall 542(542B) of a housing 531. Further, the ink cartridge 530 also includes the resilient member 294 of the second embodiment that is provided at a top wall 539 (top surface 539A) of the housing 531. However, the ink cartridge 530 does not include the raised portion 70 of the first embodiment on the top wall 539. The ink cartridge 530 does not include the protrusion 293 of the second embodiment at the bottom wall 542, either. That is, the ink cartridge 530 of the third embodiment includes both of the resiliently deformable portion of the first embodiment (resilient member 90) and the resiliently deformable portion of the second embodiment (resilient member 294).

The ink cartridge 530 also includes the protruding part 43 of the first embodiment at the top wall 539, as in the first embodiment.

The ink cartridge 530 is configured to be inserted into the cartridge-attachment portion 110 of the first embodiment. As the ink cartridge 530 is inserted forward into the cartridge holder 101 through the opening 112 of the cartridge-attachment portion 110, the resilient member 90 is caused to resiliently deform upward by the bottom wall 59 of the cartridge-attachment portion 110, as in the first embodiment (see FIG. 20).

Figure 20:
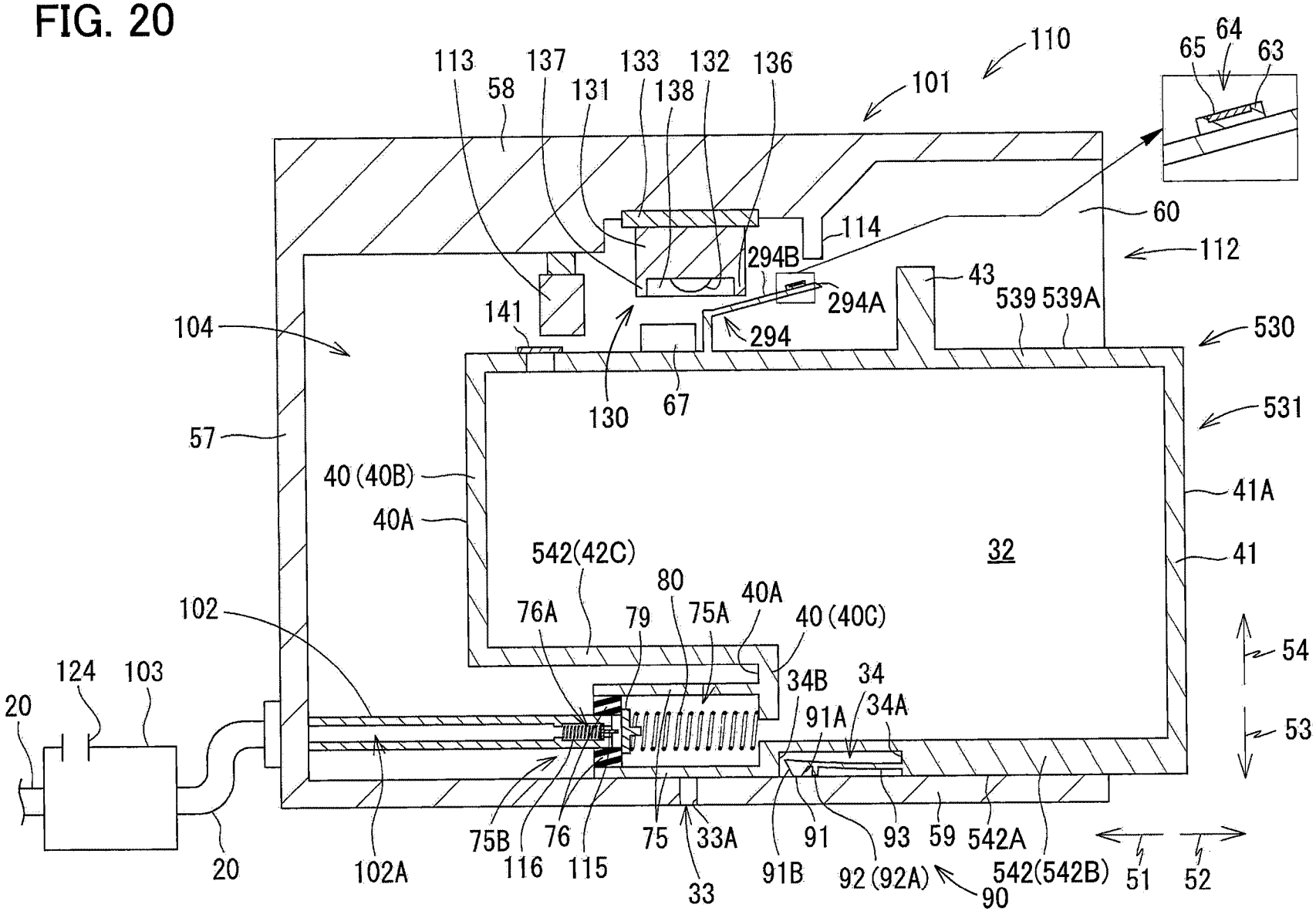
FIG. 20 is a vertical cross-sectional view illustrating a state where the ink cartridge according to the third embodiment is inserted into the cartridge-attachment section according to the first embodiment.
Figure 21:
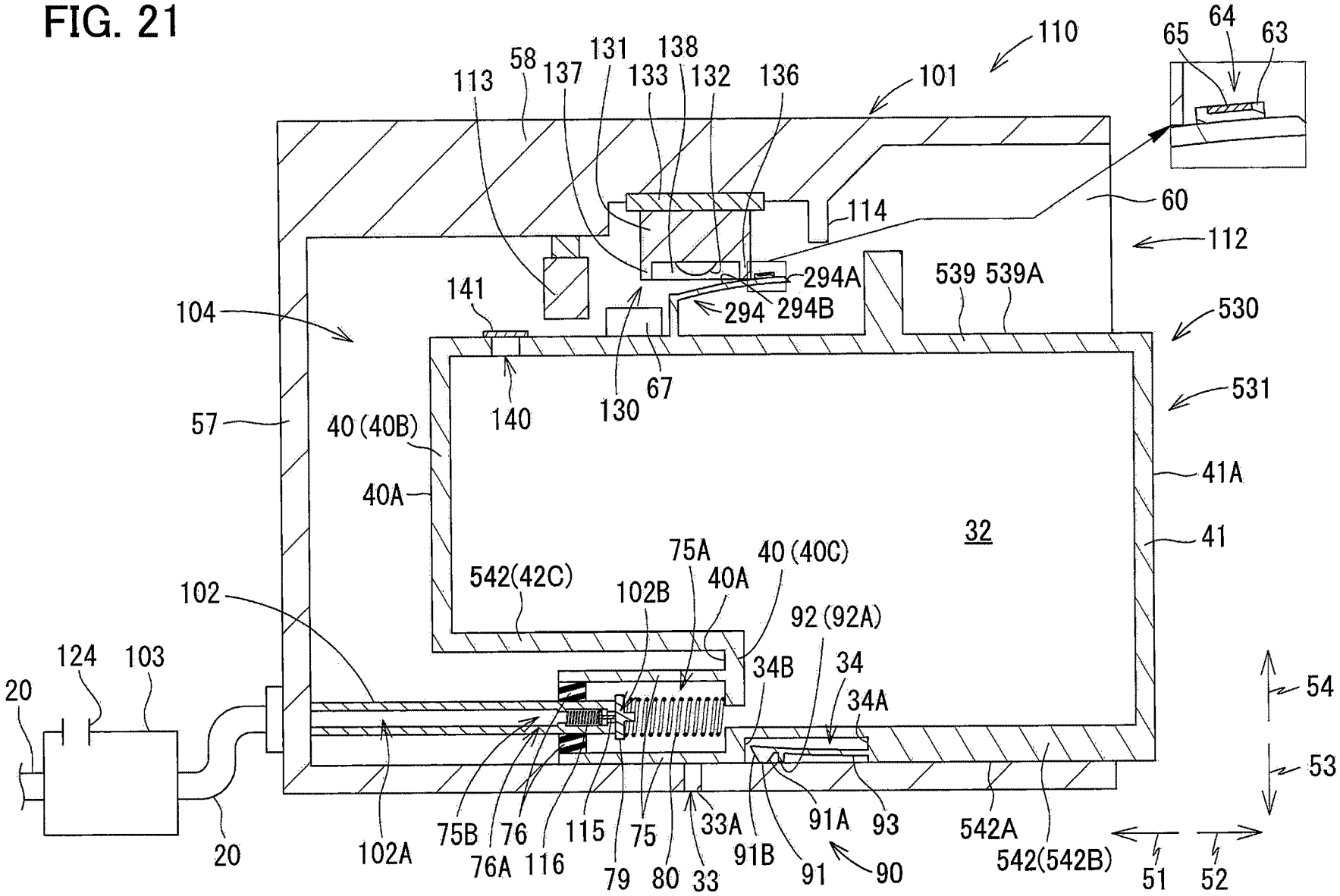
FIG. 21 is a vertical cross-sectional view illustrating a state where the ink cartridge according to the third embodiment is inserted further into the cartridge-attachment section according to the first embodiment from the state of FIG. 20.

As the ink cartridge 530 is inserted further forward from the state of FIG. 20, the resilient member 294 is resiliently deformed downward by the rear wall 136 of the connector 130 as in the second embodiment, as illustrated in FIG. 21.

Figure 22:
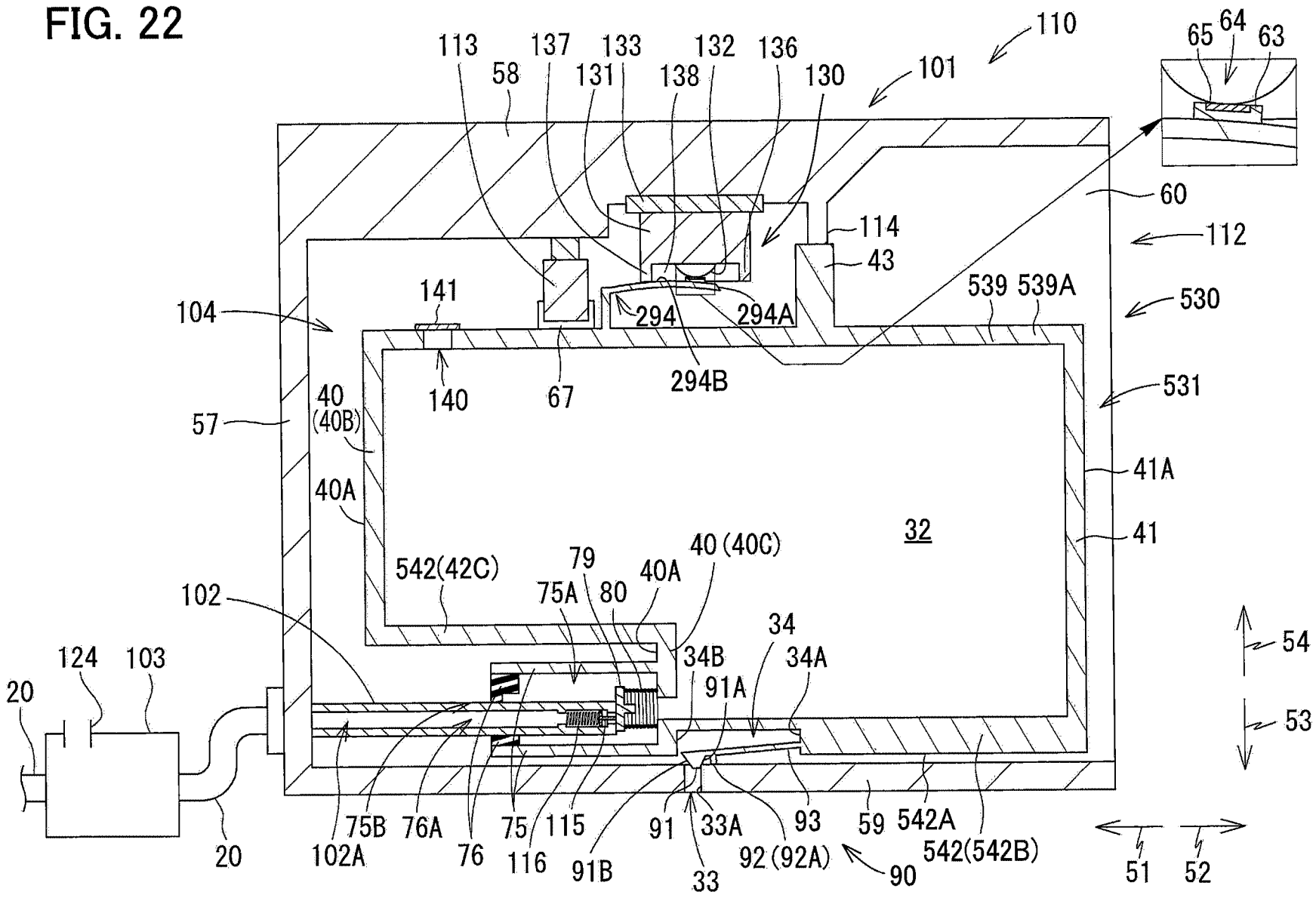
FIG. 22 is a vertical cross-sectional view illustrating a state where the ink cartridge according to the third embodiment is attached to the cartridge-attachment section according to the first embodiment.

As the ink cartridge 530 is inserted further forward from the state of FIG. 21, the resilient member 294 is moved upward due to resiliency thereof, so that the electrodes 65 of the circuit board 64 contact the contacts 132 from below, as illustrated in FIG. 22. Further, the first protrusion 91 of the resilient member 90 is moved downward due to resiliency thereof to be fitted in the depressed portion 33 of the bottom wall 59 of the cartridge-attachment portion 110.

As in the first embodiment, the position of the ink cartridge 530 is fixed in the front-rear direction by the engagement of the rear surface 91A of the first protrusion 91 with the depressed portion 33, and in the vertical direction by the contact of the protruding part 43 with the protruding part 114 of the cartridge-attachment portion 110.

Incidentally, in the state of FIG. 20, since the resilient member 90 includes the second protrusion 92, the resilient member 90 does not completely restore its original shape but is still applied with the upward reaction force from the bottom wall 59, as in the first embodiment. However, according to the structure of the third embodiment, since the circuit board 64 can be moved upward by the resiliency of the resilient member 294, the electrodes 65 can make contact with the contacts 132 from below. Hence, unlike the first embodiment, the ink cartridge 530 as a whole need not be moved upward by the upward reaction force applied from the bottom wall 59. In other words, the resilient member 90 may not include the second protrusion 92 in the third embodiment.

According to the structure of the third embodiment, the rear surface 91A of the first protrusion 91 can move downward due to the resilient deformation of the resilient member 90 to be engaged with the depressed portion 33 of the cartridge-attachment portion 110.

Further, in the third embodiment, the circuit board 64 is movable in the vertical direction by the resilient deformation of the resilient member 294. With this structure, during insertion of the ink cartridge 530 into the cartridge-attachment portion 110, the circuit board 64 can move toward the contacts 132 while moving in the front-rear direction. The circuit board 64 can thus evade a component of the cartridge-attachment portion 110 (the rear wall 136 of the connector 130) that is positioned in the way of the moving path of the circuit board 64 during insertion of the ink cartridge 530.

In the attached state of the ink cartridge 530, the bottom surface 92A of the second protrusion 92 is in contact with the cartridge-attachment portion 110 (the bottom wall 59) to restrict the resilient restoration of the resilient member 90. At this time, the resilient member 90 is applied with an upward reaction force from the cartridge-attachment portion 110 (the bottom wall 59). The ink cartridge 530 is thus moved upward by the reaction force, thereby facilitating the contact of the electrodes 65 on the circuit board 64 with the contacts 132 of the cartridge-attachment portion 110.

Fourth Embodiment

In the above-described embodiments, at least one of the circuit board 64 and the rear surface 91A of the resilient member 90 (the surface engageable with the cartridge-attachment portion 110) is movable relative to the housing 31, 231, 331. Alternatively, both of the circuit board 64 and the engageable surface may be arranged so as not to move relative to the housing.

Figure 23:
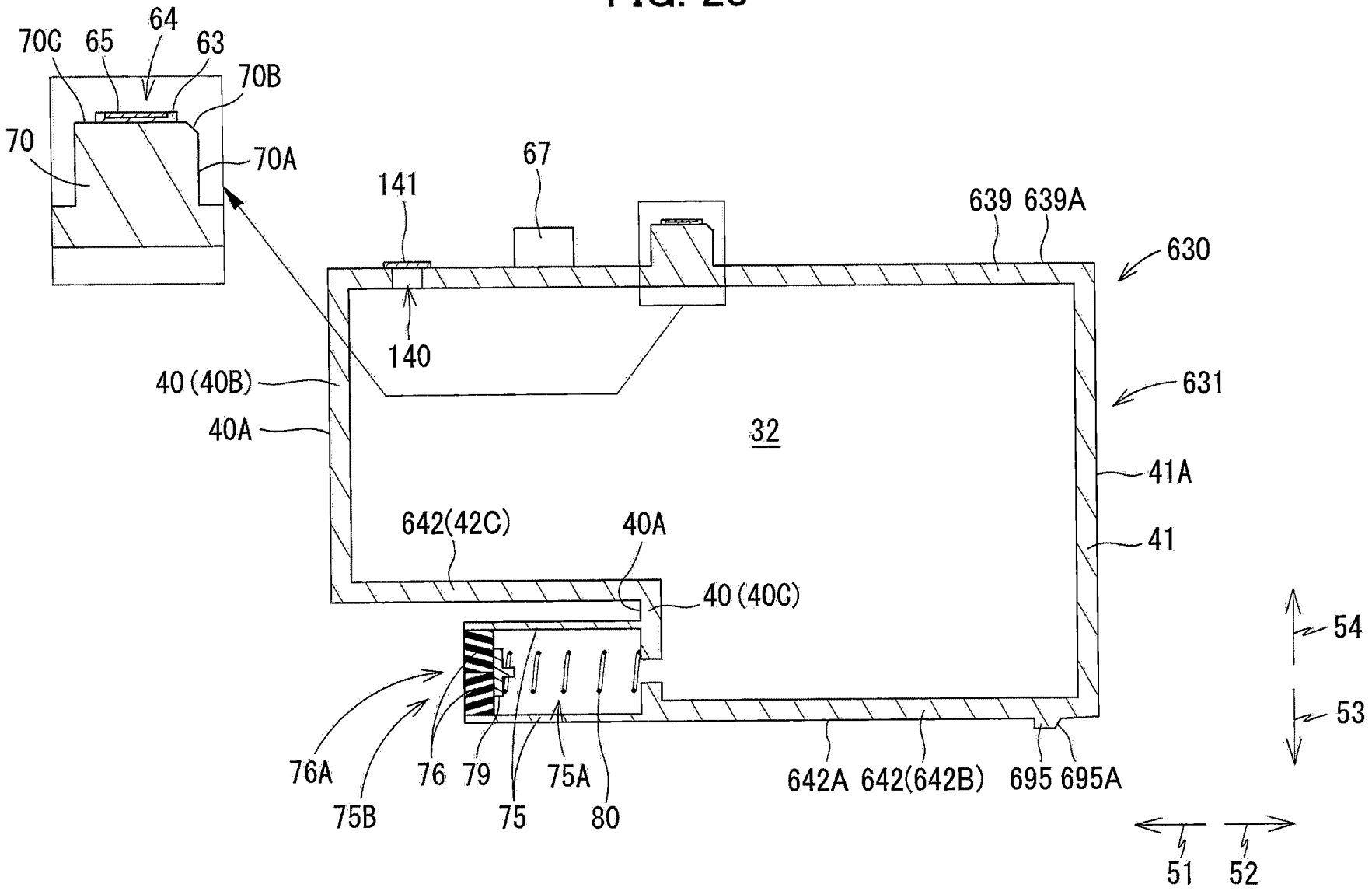
FIG. 23 is a vertical cross-sectional view of an ink cartridge according to a fourth embodiment of the disclosure in an upright posture thereof.

FIGS. 23 through 26 illustrate an ink cartridge 630 according to a fourth embodiment. Referring to FIG. 23, the ink cartridge 630 includes the raised portion 70 of the first embodiment at a top wall 639 of a housing 631. Further, the ink cartridge 630 also includes a protrusion 695 provided at a bottom wall 642 (642B) of the housing 631. Incidentally, the ink cartridge 630 does not include any of the protruding part 43, the recess 34, the resilient member 90, the protrusion 293 and the resilient member 294.

Figure 24:
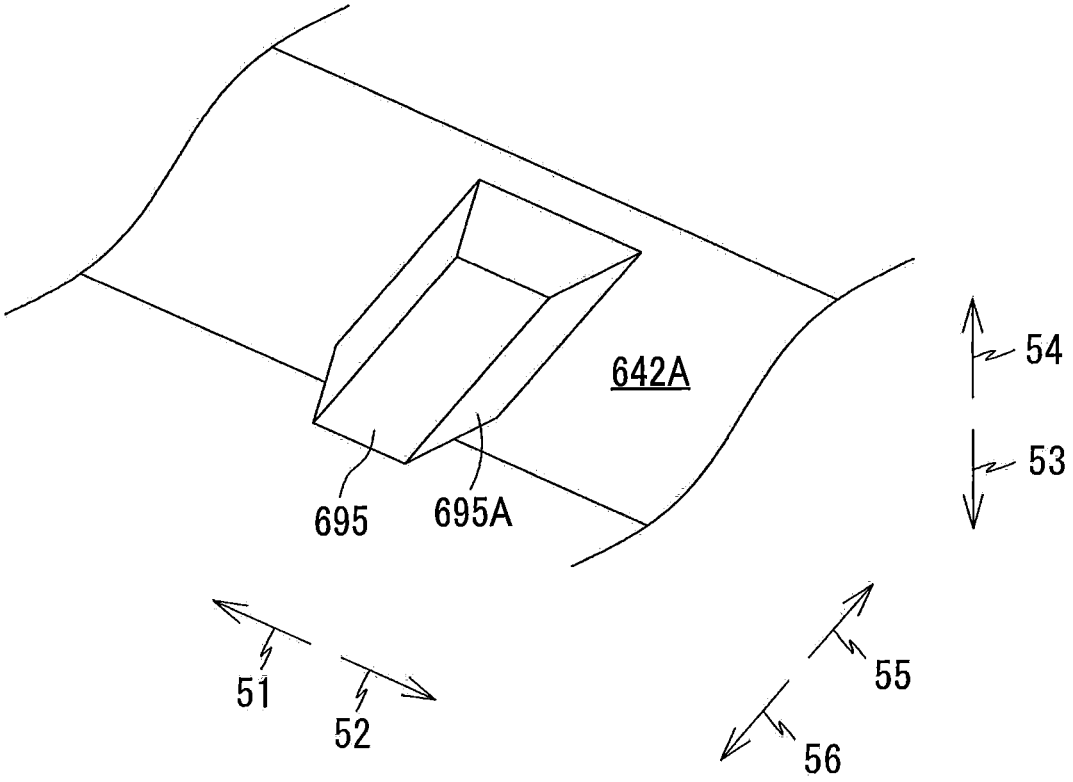
FIG. 24 is a perspective view illustrating a structure in the vicinity of a protrusion in the ink cartridge according to the fourth embodiment in the upright posture.

Referring to FIGS. 23 and 24, the protrusion 695 protrudes downward from a bottom surface 642A of the bottom wall 642 (642B). The protrusion 695 is integrally formed with the bottom wall 642 (642B). That is, the protrusion 695 is immovable relative to the housing 631. The protrusion 695 is formed on the bottom surface 642A at a position closer to the rear wall 41 than the protrusion 293 of the second embodiment is to the rear wall 41 (see FIG. 13).

The protrusion 695 has a rear surface 695A sloping upward toward the rear. The rear surface 695A is positioned rearward of the circuit board 64.

Figure 25:
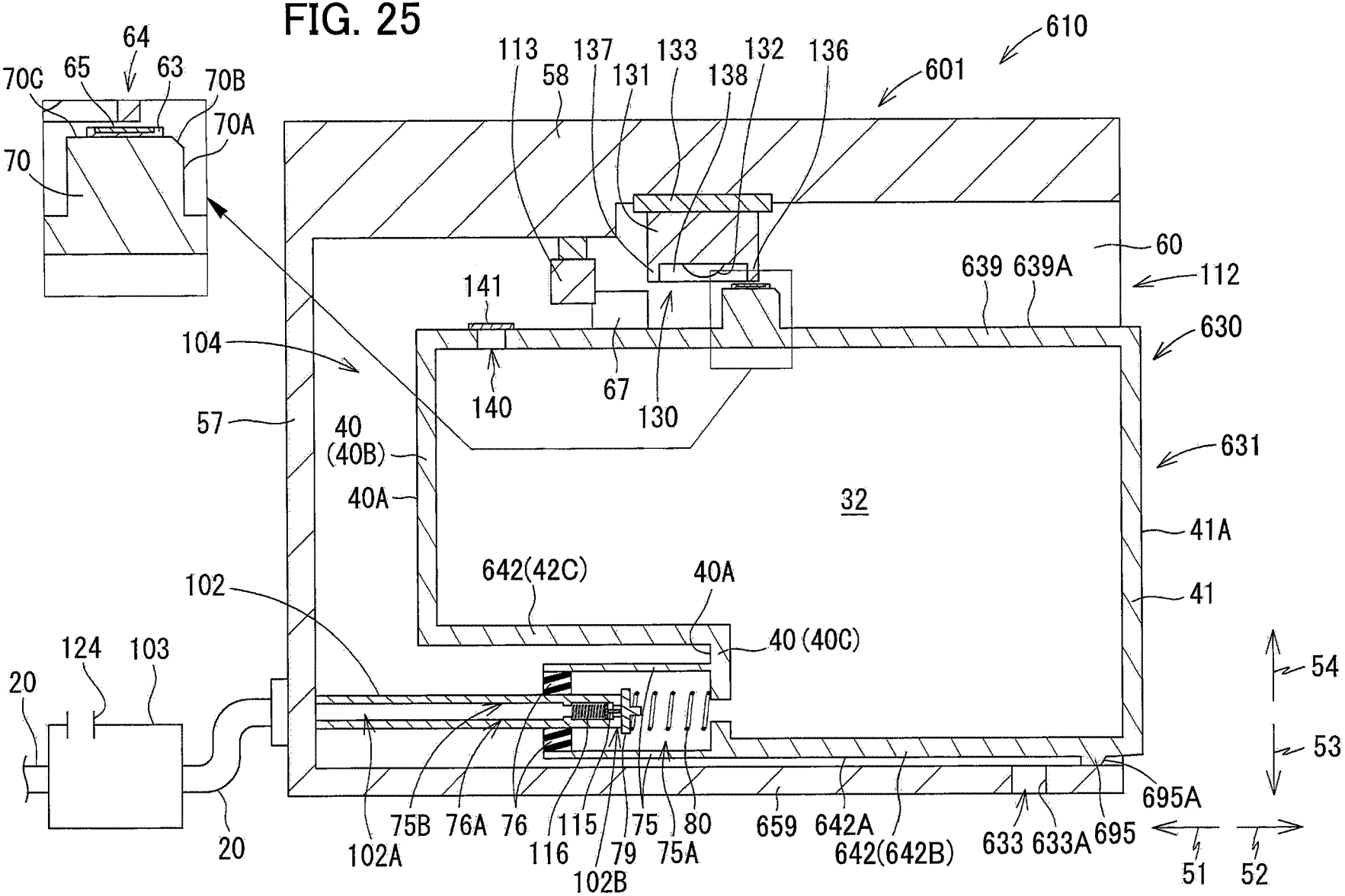
FIG. 25 is a vertical cross-sectional view illustrating a state where the ink cartridge according to the fourth embodiment is inserted into a cartridge-attachment section according to the fourth embodiment.
Figure 26:
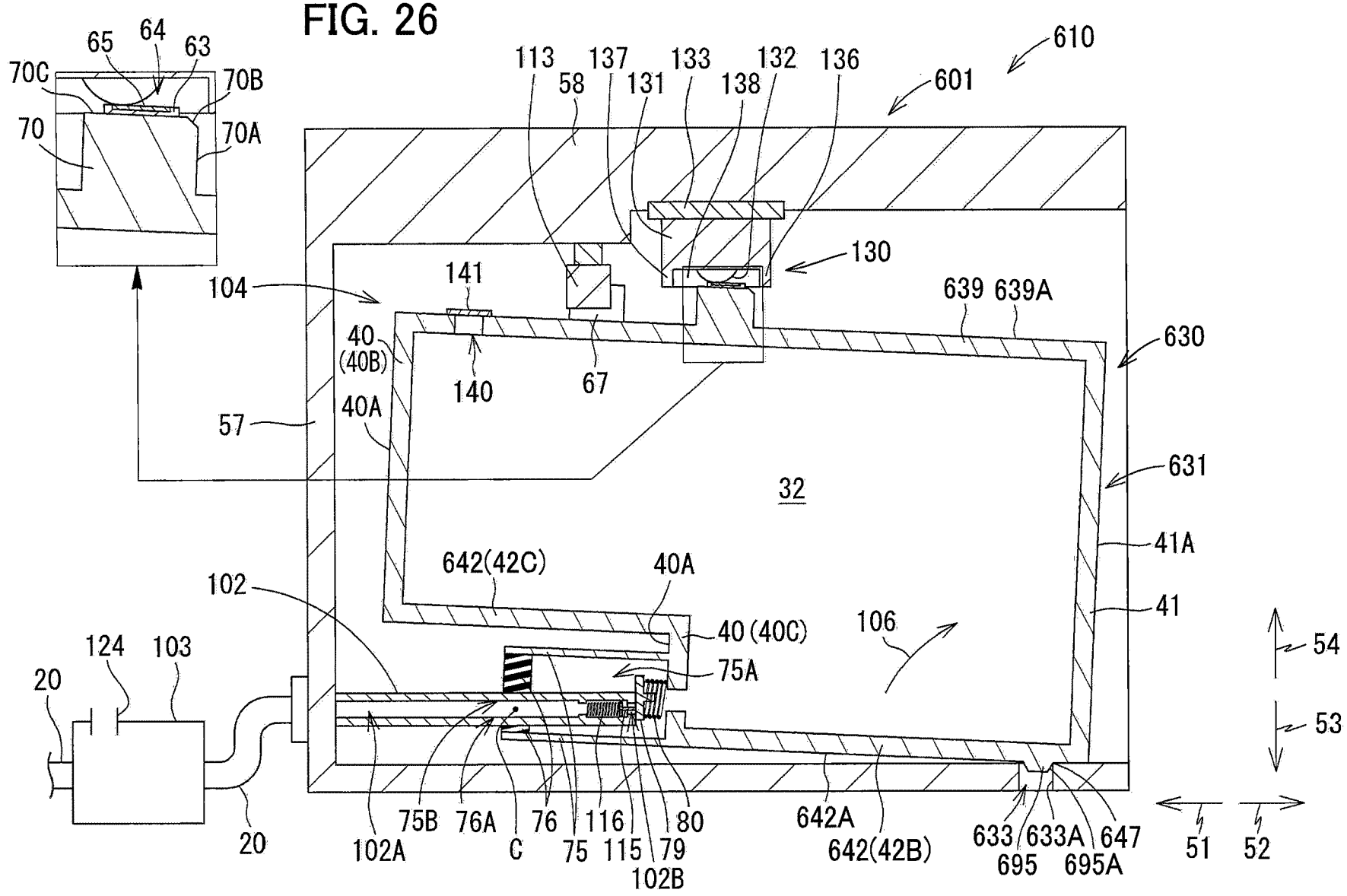
FIG. 26 is a vertical cross-sectional view illustrating a state where the ink cartridge according to the fourth embodiment is attached to the cartridge-attachment section according to the fourth embodiment.

The ink cartridge 630 is configured to be inserted into a cartridge-attachment portion 610. As illustrated in FIG. 25, the cartridge-attachment portion 610 is not provided with the protruding part 114, unlike the cartridge-attachment portion 110 of the first embodiment. Further, the cartridge-attachment portion 610 includes a cartridge holder 601 whose bottom wall 659 is formed with a depressed portion 633. The depressed portion 633 is positioned closer to the opening 112 than the depressed portion 33 of the first embodiment is to the opening 112 in the front-rear direction.

The ink cartridge 630 is inserted forward into the cartridge holder 601 through the opening 112 while the protrusion 695 is supported by the bottom wall 659 from below. In accordance with forward insertion of the ink cartridge 630, the circuit board 64 moves below the rear wall 136 and passes the rear wall 136.

As the ink cartridge 630 is inserted further forward into the cartridge holder 601, the protrusion 695 comes to a position vertically above the depressed portion 633 of the bottom wall 659. The protrusion 695 is thus fitted into the depressed portion 633 by the self-weight of the ink cartridge 630 (see FIG. 26). At this time, since the coil springs 80 and 116 apply the rearward urging forces to the entire ink cartridge 630 (housing 631), the rear surface 695A of the protrusion 695 abuts against a side surface 633A of the depressed portion 633 from frontward thereof. As a result of the abutment of the rear surface 695A against the side surface 633A, the ink cartridge 630 is fixed in position with regard to the front-rear direction within the cartridge holder 601. The ink cartridge 630 at this time can no longer move further rearward. However, due to the rearward urging forces of the coil springs 80 and 116, the ink cartridge 630 is caused to pivot upward, in a direction indicated by an arrow 106, about a contact point 647 between the rear surface 695A and the side surface 633A (see FIG. 26). In accordance with the upward pivotal movement of the ink cartridge 630, the circuit board 64 is moved upward, thereby coming into contact with the contacts 132 from below.

In order to remove the ink cartridge 630 from the cartridge holder 601 of the cartridge-attachment portion 610, the user holds the ink cartridge 630 and moves the ink cartridge 630 rearward. As the ink cartridge 630 is moved rearward, an upper edge of the depressed portion 633 (i.e., an upper edge of the side surface 633A) is guided rearward relatively along the rear surface 695A of the protrusion 695. The protrusion 695 is thus moved onto the bottom wall 659, so that the protrusion 695 no longer prevents the rearward movement of the ink cartridge 630.

In the meantime, while the protrusion 695 moves onto the bottom wall 659, the ink cartridge 630 is pivoted downward in a direction opposite to the arrow 106 to separate the circuit board 64 from the contacts 132. The circuit board 64 is thus moved below the rear wall 136, so that the circuit board 64 is now movable toward the rear without interference with the rear wall 136. When the user moves the ink cartridge 630 further rearward from this state, the ink cartridge 630 can be detached from the cartridge-attachment portion 610 through the opening 112.

According to the structure of the fourth embodiment, the ink cartridge 630 in the attached state is urged rearward by the coil springs 80 and 116. Accordingly, the rear surface 695A of the protrusion 695 applies a rearward moment to the cartridge-attachment portion 610. As a result, the ink cartridge 630 in the attached state is urged to pivot upward about the contact point 647 between the rear surface 695A and the cartridge-attachment portion 610 (depressed portion 633), such that part of the ink cartridge 630 positioned rearward of the contact point 647 moves downward, while part of the ink cartridge 630 positioned forward of the contact point 647 moves upward. Here, since the circuit board 64 is positioned forward of the contact point 647, the circuit board 64 is moved upward in accordance with the upward pivoting of the ink cartridge 630. The electrodes 65 of the circuit board 64 thus come into contact with the contacts 132 from below by the upward movement of the circuit board 64.

Other Variations and Modifications

In the embodiments described above, the resilient members 90, 294 are leaf springs. However, the resilient members 90, 294 may not necessarily be leaf springs, but may be coil springs, for example, as illustrated in FIG. 27.

Figure 27:
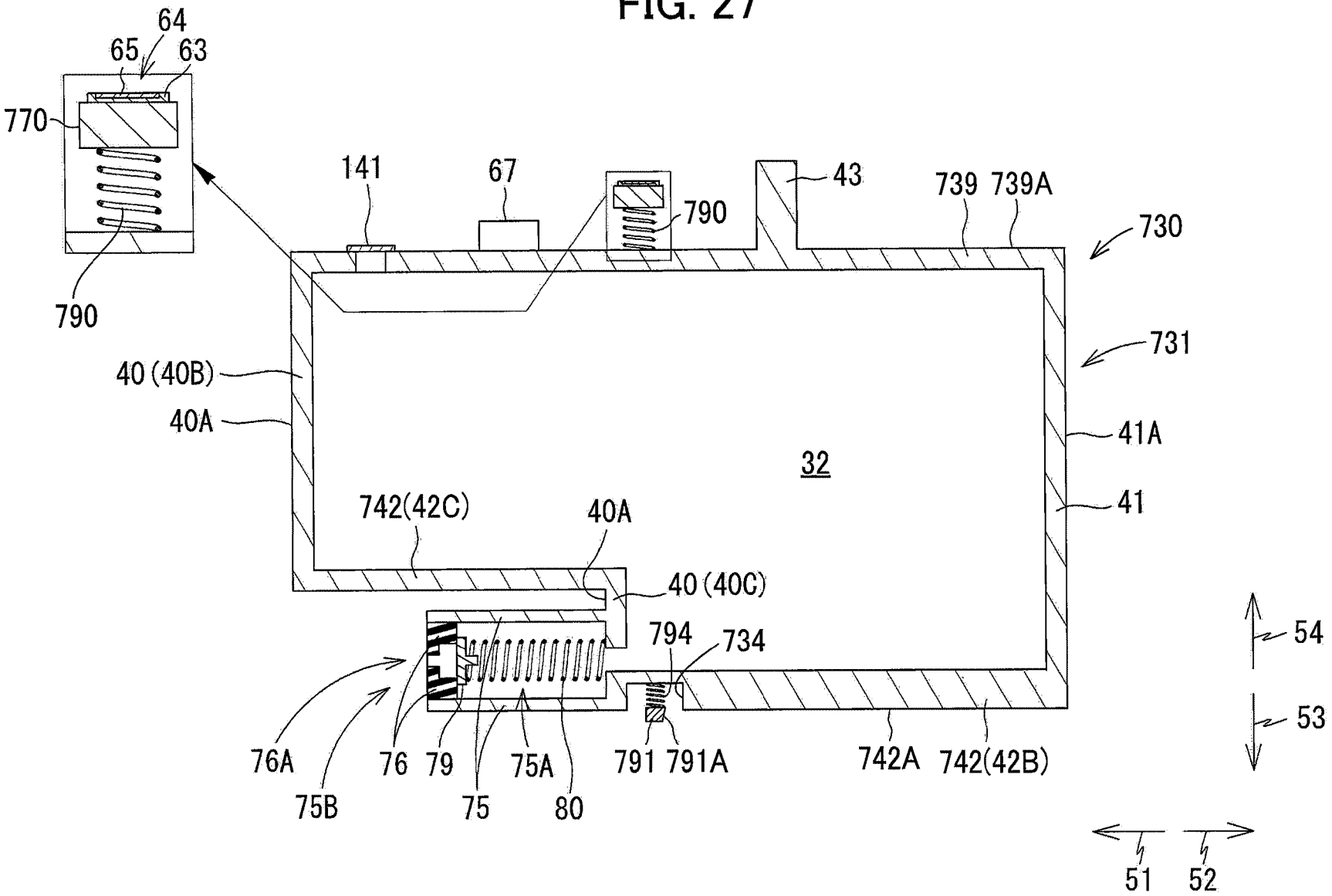
FIG. 27 is a vertical cross-sectional view of an ink cartridge according to a variation of the first to fourth embodiments in an upright posture thereof.

An ink cartridge 730 according to a variation of FIG. 27 includes a housing 731, and a resilient member 790 (coil spring) connecting a movable member 770 to a top wall 739 (top surface 739A) of the housing 731. The circuit board 64 is supported on the movable member 770. The resilient member 790 movably supports the movable member 770 in the vertical direction.

A resilient member 794 (coil spring) is also provided to connect a movable member 791 (corresponding to the first protrusion 91 of the first and third embodiments) to a bottom wall 742 (bottom surface 742A) of the housing 731. The movable member 791 is configured to be received in a recess 734 formed in the bottom wall 742. That is, one end of the resilient member 794 is connected to the recess 734 (bottom wall 742) and another end of the resilient member 794 is connected to the movable member 791. The movable member 791 is thus movable vertically relative to the housing 731. The movable member 791 has a rear surface 791A sloping upward toward the rear.

Further, in the foregoing embodiments, the substrate 63 of the circuit board 64 may have a sloped rear surface that slopes downward toward the rear. With this structure, the sloped rear surface of the substrate 63 may guide the rear wall 136 of the connector 130 relatively when the substrate 63 abuts on the rear wall 136 from frontward thereof during detachment of the ink cartridge 30, 230, 530, 630. Hence, the substrate 63 is less likely to get stuck with the rear wall 136 than otherwise.

In the second embodiment, the substrate 63 of the circuit board 64 may have a sloped front surface that slopes downward toward the front. With this structure, the sloped front surface of the substrate 63 may guide the rear wall 136 of the connector 130 relatively when the substrate 63 abuts on the rear wall 136 from rearward thereof during insertion of the ink cartridge 230. Hence, the substrate 63 is less likely to get stuck with the rear wall 136 than otherwise.

In the foregoing embodiments, the valve 79 serves to open and close the passage 75A (opening 75B) of the cylinder 75. However, instead of the valve 79, a seal may be used to close the opening 75B, for example.

More specifically, a seal may be affixed to a front surface of the cylinder 75 so as to close the through-hole 76A in the ink cartridge 30, 230, 530, 630 prior to insertion into the cartridge-attachment portion 110, 210, 610. Since the through-hole 76A is closed by the seal, ink in the storage chamber 32 does not flow out from the ink cartridge 30, 230, 530, 630 through the through-hole 76A. The seal may be punctured and broken by the tube 102 of the cartridge-attachment portion 110, 210, 610 during the insertion of the ink cartridge 30, 230, 530, 630 into the cartridge-attachment portion 110, 210, 610, so that the through-hole 76A is opened to provide communication between the storage chamber 32 (passage 75A) and the interior space 102A of the tube 102.

In this case, preferably, an urging member for urging the inserted ink cartridge 30, 230, 530, 630 rearward (a coil spring, for example) be provided either at the ink cartridge 30, 230, 530, 630 or at the cartridge-attachment portion 110, 210, 610. Such an urging member can apply a rearward urging force to the ink cartridge 30, 230, 530, 630 in a state where the engaging surface of the ink cartridge 30 (the rear surface 91A of the first protrusion 91 in the first and third embodiments; the rear surface 293A of the protrusion 293 in the second embodiment; the rear surface 695A of the protrusion 695 in the fourth embodiment) faces the cartridge holder 101, 201, 601 of the cartridge-attachment portion 110, 210, 610. The engaging surface of the ink cartridge 30, 230, 530, 630 thus contacts the cartridge holder 101, 201, 601 (the depressed portion 33, 233 or 633) from frontward thereof to provide positioning of the ink cartridge 30, 230, 530, 630 in the front-rear direction within the cartridge holder 101, 201, 601.

In the depicted embodiments, ink is described as an example of liquid, but the liquid cartridge of the disclosure may store liquid other than ink, such as pretreatment liquid that is ejected onto sheets or the like prior to ink during a printing operation, or water for cleaning the recording head 21.

It should be apparent to those who skilled in the art that the first to fourth embodiments, modifications thereto and variations described above may be combined with one another as appropriate.

<Remarks>

The ink cartridges 30, 230, 330, 430, 530, 630 and 730 are examples of a liquid cartridge. The storage chamber 32 is an example of a storage chamber. The passages 75A is an example of a liquid passage. The sealing member 76 is an example of a sealing member. The circuit board 64 is an example of a circuit board. The electrodes 65 are an example of an electrical contact. The rear surfaces 91A, 293A, 393A, 493A, 695A, 791A are examples of a restricting surface. The resilient members 90 and 794 are examples of a first resilient member. The bottom surface 92A of the resilient member 90 is an example of an abutment surface. The main body 93 of the resilient member 90 is an example of a main portion. The second protrusion 92 of the resilient member 90 is an example of a protrusion. The first protrusion 91 is an example of another protrusion. The resilient members 294, 590, and 790 are examples of a second resilient member. The first protrusions 91, 393, 493 and movable member 791 are examples of a restricting portion. The operation lever 436 is an example of an operating portion. The coil spring 80 is an example of an urging member. The raised portion 70 is an example of a support portion. The sloped surface 70B is an example of a sloped surface. The frontward direction 51 is an example of a first lateral direction. The rearward direction 52 is an example of a second lateral direction.

What is claimed is:

1. A liquid cartridge comprising:

a housing defining a storage chamber therein;

a liquid passage extending in a first lateral direction from the housing when the housing is in an operational posture, the liquid passage being in communication with the storage chamber;

a sealing member provided in the liquid passage;

a circuit board comprising an electrical contact, the electrical contact facing upward when the housing is in the operational posture; and a restricting surface positioned below the liquid passage, the restricting surface being capable of preventing the housing from moving in a second lateral direction opposite the first lateral direction, wherein the liquid passage is positioned closer to the restricting surface than the circuit board is to the restricting surface with respect to a vertical direction perpendicular to the first lateral direction, wherein the circuit board and the restricting surface are positioned further in the second lateral direction relative to the sealing member, and wherein the restricting surface slopes upward as extending further in the second lateral direction.

2. The liquid cartridge according to claim 1, further comprising:

a first resilient member provided at the housing and resiliently deformable; and an abutment surface provided at the first resilient member and configured to restrict the first resilient member from restoring its original shape, wherein the restricting surface is movable vertically relative to the housing in accordance with resilient deformation of the first resilient member, and wherein the circuit board is immovably supported relative to the housing.

3. The liquid cartridge according to claim 2, wherein the first resilient member is a leaf spring.

4. The liquid cartridge according to claim 1, further comprising a resilient member provided at the housing and movably supporting the circuit board relative to the housing, wherein the circuit board is vertically movable relative to the housing.

5. The liquid cartridge according to claim 4, wherein the restricting surface is immovable relative to the housing.

6. The liquid cartridge according to claim 4, wherein the resilient member is a leaf spring.

7. The liquid cartridge according to claim 4, further comprising a restricting portion supported by the housing and having the restricting surface, the restricting portion being movable relative to the housing between a restricting position where the restricting surface restricts the housing from moving in the second lateral direction and a non-restricting position where the restricting surface allows the housing to move in the second lateral direction.

8. The liquid cartridge according to claim 7, further comprising an operating portion extending in the second lateral direction from the restricting portion, the operating portion being configured to move the restricting portion between the restricting position and the non-restricting position.

9. The liquid cartridge according to claim 4, wherein the resilient member has one end connected to the housing and another end positioned further in the second lateral direction relative to the one end, the another end being formed with a sloped surface sloping downward as extending further in the second lateral direction.

10. The liquid cartridge according to claim 1, further comprising:

a first resilient member provided at the housing and resiliently deformable; and a second resilient member provided at the housing and movably supporting the circuit board relative to the housing, the circuit board being vertically movable relative to the housing, wherein the restricting surface is vertically movable relative to the housing in accordance with resilient deformation of the first resilient member.

11. The liquid cartridge according to claim 10, wherein the first resilient member comprises:

a main portion connected to the housing; and a protrusion provided on the main portion and protruding downward therefrom.

12. The liquid cartridge according to claim 11, wherein the first resilient member further comprises another protrusion provided on the main portion, the another protrusion having the restricting surface as a printer engaging surface.

13. The liquid cartridge according to claim 10, wherein the first resilient member is a leaf spring.

14. The liquid cartridge according to claim 10, wherein the second resilient member is a leaf spring.

15. The liquid cartridge according to claim 1, wherein the sealing member is elastically deformable, and wherein the circuit board has a portion positioned vertically above the restricting surface.

16. The liquid cartridge according to claim 1, further comprising an urging member configured to urge the housing in the second lateral direction, wherein the circuit board is immovably supported relative to the housing and is positioned further in the first lateral direction relative to the restricting surface, and wherein the restricting surface is immovable relative to the housing.

17. The liquid cartridge according to claim 1, wherein the housing comprises a support portion supporting the circuit board, and wherein the support portion has a rear surface facing in the second lateral direction, the rear surface comprising a sloped surface sloping downward as extending further in the second lateral direction.

18. A liquid cartridge comprising:

a housing defining a storage chamber therein;

a liquid passage extending in a first lateral direction from the housing when the housing is in an operational posture, the liquid passage being in communication with the storage chamber;

a sealing member provided in the liquid passage;

a circuit board comprising an electrical contact, the electrical contact facing upward when the housing is in the operational posture;

a restricting surface positioned below the liquid passage, the restricting surface being capable of preventing the housing from moving in a second lateral direction opposite the first lateral direction; and a resilient member provided at the housing and movably supporting the circuit board relative to the housing, wherein the liquid passage is positioned closer to the restricting surface than the circuit board is to the restricting surface with respect to a vertical direction perpendicular to the first lateral direction, wherein the circuit board and the restricting surface are positioned further in the second lateral direction relative to the sealing member and wherein the circuit board is vertically movable relative to the housing.

19. The liquid cartridge according to claim 18, wherein the restricting surface is immovable relative to the housing.

20. The liquid cartridge according to claim 18, wherein the resilient member is a leaf spring.

* * * * *